US009694236B2

(12) United States Patent
Rost

(10) Patent No.: US 9,694,236 B2
(45) Date of Patent: Jul. 4, 2017

(54) STABILITY AND STRENGTH TRAINING DEVICE

(71) Applicant: Innovative Rehab Products, LLC, Redmond, OR (US)

(72) Inventor: Brian Mitchell Rost, Redmond, OR (US)

(73) Assignee: Innovative Rehab Products, LLC, Redmond, OR (US)

( * ) Notice: Subject to any disclaimer, the term of this patent is extended or adjusted under 35 U.S.C. 154(b) by 73 days.

(21) Appl. No.: 14/590,789

(22) Filed: Jan. 6, 2015

(65) Prior Publication Data

US 2015/0190672 A1 Jul. 9, 2015

Related U.S. Application Data

(60) Provisional application No. 61/924,170, filed on Jan. 6, 2014.

(51) Int. Cl.
*A63B 21/00* (2006.01)
*A63B 21/06* (2006.01)
(Continued)

(52) U.S. Cl.
CPC ..... *A63B 23/0355* (2013.01); *A63B 21/0004* (2013.01); *A63B 21/00065* (2013.01); *A63B 21/0618* (2013.01); *A63B 21/075* (2013.01); *A63B 21/0724* (2013.01); *A63B 21/4035* (2015.10); *A63B 22/16* (2013.01);
(Continued)

(58) Field of Classification Search
CPC . A63B 23/0355; A63B 23/1236; A63B 22/16; A63B 26/003; A63B 21/4035; A63B 21/075; A63B 21/0724; A63B 21/0004; A63B 21/0618; A63B 23/03516; A63B 21/00065; A63B 23/03508
USPC ..... 482/92, 93, 106–110, 121–122, 126, 482/131–132, 139, 140–142
See application file for complete search history.

(56) References Cited

U.S. PATENT DOCUMENTS 4,801,140 A * 1/1989 Bergeron ..... A63B 21/0004 280/87.01
4,880,228 A * 11/1989 Caruthers ..... A63B 21/0605 482/108

(Continued)

*Primary Examiner* — Stephen Crow
*Assistant Examiner* — Garrett Atkinson
(74) *Attorney, Agent, or Firm* — McCoy Russell LLP

(57) ABSTRACT

A transformable exercise device used both for stability and strength training is disclosed. Embodiments include a main portion comprising a sphere that may be used wholly in the manner of a medicine ball, kettlebell, rolling device, or separated into two hemisphere elements and used for various exercises including push-ups, standing balance, agility training, and weight training. The two hemisphere elements may be easily and securely locked together with a U-shaped locking mechanism that, when actuated, is congruent with the surface of the sphere to create a medicine ball configuration. The locking mechanism may be modified with various handle attachments, or removed and replaced with separate components added externally to the device providing various hand or foot placements, or alter the nature of the exercise equipment. The device may be used in conjunction with current technology to provide visual and auditory feedback on user's balance or repetitions while performing exercises.

14 Claims, 16 Drawing Sheets

(51) Int. Cl.

| | |
|---|---|
| ***A63B 23/035*** | (2006.01) |
| ***A63B 21/072*** | (2006.01) |
| ***A63B 21/075*** | (2006.01) |
| ***A63B 22/16*** | (2006.01) |
| ***A63B 23/12*** | (2006.01) |
| ***A63B 26/00*** | (2006.01) |

(52) U.S. Cl.
CPC .. *A63B 23/03508* (2013.01); *A63B 23/03516* (2013.01); *A63B 23/1236* (2013.01); *A63B 26/003* (2013.01)

(56) References Cited

U.S. PATENT DOCUMENTS 5,222,929 A * 6/1993 Duda ..... A63B 21/0603 482/1
5,242,348 A * 9/1993 Bates ..... A63B 21/0004 482/105
5,250,014 A * 10/1993 Chang ..... A63B 21/075 482/106
6,190,292 B1 * 2/2001 Panes ..... A63B 21/06 482/109
6,387,022 B1 * 5/2002 Smith ..... A63B 43/02 482/106
6,527,675 B1 * 3/2003 Yu ..... A63B 21/22 482/110
6,629,908 B2 * 10/2003 Hamady ..... A63B 21/222 482/110
6,773,377 B1 * 8/2004 Yu ..... A61H 7/003 482/108
7,052,445 B2 * 5/2006 Ekhaus ..... A63B 21/072 482/108
7,175,573 B1 * 2/2007 Huang ..... A63B 21/0004 446/236
7,326,158 B1 * 2/2008 Wang ..... A63B 21/06 482/132
7,381,157 B2 * 6/2008 Blateri ..... A63B 21/075 482/106
7,585,262 B1 * 9/2009 Vayntraub ..... A63B 23/12 482/141
7,883,452 B1 * 2/2011 Chen ..... A63B 21/072 482/108
8,083,649 B1 * 12/2011 Cordova ..... A63B 21/00069 482/45
8,105,218 B1 * 1/2012 Vayntraub ..... A63B 23/1236 482/141
8,267,845 B2 * 9/2012 Taylor ..... A63B 26/003 482/140
8,382,647 B1 * 2/2013 Hodes ..... A63B 21/072 482/108
8,454,483 B1 * 6/2013 Bradley ..... A63B 21/072 482/44
8,870,719 B2 * 10/2014 Johnson ..... A63B 21/075 482/44
8,911,334 B1 * 12/2014 Cotter ..... A63B 43/02 482/105
8,944,971 B2 * 2/2015 Shorter ..... A63B 21/072 482/107
2003/0186790 A1 * 10/2003 Yu ..... A63B 21/0608 482/110
2005/0101454 A1 * 5/2005 Dworzan ..... A63B 21/22 482/110
2007/0225133 A1 * 9/2007 Castro ..... A63B 21/0004 482/140
2008/0081744 A1 * 4/2008 Gormley ..... A63B 21/0728 482/93
2008/0305935 A1 * 12/2008 Sanghavi ..... A63B 21/0023 482/91
2011/0251029 A1 * 10/2011 Verheem ..... A63B 21/0004 482/110
2011/0263394 A1 * 10/2011 Viselman ..... A63B 21/00061 482/93
2012/0053024 A1 * 3/2012 Mendoza ..... A63B 21/072 482/106
2012/0139727 A1 6/2012 Houvener et al.
2012/0157270 A1 * 6/2012 Johnson ..... A63B 21/075 482/93
2012/0184418 A1 * 7/2012 Wilson ..... A63B 21/00043 482/112
2012/0258847 A1 10/2012 Lafferty
2012/0322631 A1 * 12/2012 Januszek ..... A63B 21/072 482/108
2013/0059701 A1 * 3/2013 Santa Cruz ..... A63B 21/0606 482/108
2013/0130848 A1 5/2013 Homsi et al.
2013/0316886 A1 * 11/2013 Lynch ..... A63B 26/003 482/146
2014/0005011 A1 * 1/2014 Hess, II ..... A63B 21/06 482/106
2015/0321041 A1 * 11/2015 Stephan ..... A63B 43/02 482/132

* cited by examiner

STABILITY AND STRENGTH TRAINING DEVICE

CROSS-REFERENCE TO RELATED APPLICATIONS

This application claims the benefit of U.S. Provisional Patent Application No. 61,924,170, filed Jan. 6, 2014, and entitled "Stability and Strength Training Device", the complete contents of which are hereby incorporated herein by reference for all purposes.

BACKGROUND

The present disclosure relates to a transformable exercise device that can be used for both balance and strength training. The device may comprise of two equally sized hemispheres that may be used individually as dumbbells, push-up handles, or lower extremity agility and/or balance equipment. Attachments to the device may further alter the nature of the exercise apparatus. The two hemispheres may also be placed together to form a single sphere that can be used in a similar manner as a medicine ball or, with appropriate attachments, a kettlebell, or rolling device. The device may be equipped to accommodate electronic devices that can provide proprioceptive and positional feedback to the user. The device may be equipped to add or subtract weight.

SUMMARY

The present disclosure relates to a transformable exercise device designed to provide both stability and strength training to the user. The device may comprise of two equally sized hemispheres that can be used independently as push-up devices, dumbbells, agility training equipment, or locked together to form a medicine ball like device. Further, various exercise attachments may be added to alter the device including, but not limited to, a standing balance device, kettlebell, rolling device, or alternate push-up apparatus. The exercise device may also be used with current electronic devices such as smart phones or tablets to provide the user proprioceptive or positional feedback. In some examples, the device may be altered in weight for different user levels by the addition or subtraction of weighted material.

Accordingly, in one embodiment, a pair of hemispherical push-up exercise devices may be utilized to provide multi-directional instability for the user while still maintaining the safety of the device by placing the handles below where the center of mass would be for the entire sphere.

In another embodiment, the two hemispherical push-up exercise devices may be combined into a single spherical object, similar to a medicine ball, through a pair of U-shaped locking mechanisms.

In further embodiments, a series of exercise devices may be configured by the insertion of various exercise attachments that lock directly into either side of each hemispherical push-up exercise device, or the conjoined medicine ball configuration using a pair of U-shaped locking mechanisms. The attachments will include, but are not limited to, a single or pair of "kettlebell" style handles, a pair of foot plates to provide a standing balance device, a pair of handle bars that may be inserted into a single hemisphere to provide an alternate push-up apparatus with a single fulcrum, and a free-spinning handle bar to form a rolling device.

In another embodiment, an exercise device compatible with electronics, such as smart phones and tablets, that can measure the balance and proprioceptive awareness of the user during balancing activities, may be added to the device.

In a further embodiment, the exercise device may comprise of, or be fitted with, various weights and materials that are dependable, inexpensive, and effective in accomplishing-the-intended purposes of the exercise device.

This summary is provided to introduce a selection of concepts in a simplified form that are further described below in the Detailed Description. This summary is not intended to identify key features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The present disclosure relates to a transformable exercise device designed to develop both strength and stability for the user. It may be comprised of two equal sized hemispheres that may be used separately for various push-up exercises, as dumbbells, or standing balance exercises, or conjoined as a single sphere by a pair of U-shaped locking members and used as various forms of exercise devices such as a medicine ball, a rolling abdominal strengthening device, or a kettlebell. Each hemisphere may comprise of a recessed handle that is positioned below the center of mass of the sphere, thus providing a push-up handle that is both multi-directionally unstable while still being safe for the user. The recessed handles may also function as a receptacle for the U-shaped locking members that may conjoin the device into a single medicine ball, or to accept the various exercise attachments to create multiple pieces of exercise equipment. The flat surfaces of the hemispheres may be designed with inter-locking surfaces to prevent slipping of the two hemispheres when conjoined. The U-shaped locking mechanism and various exercise attachments may be configured with any variety of locking mechanism including, but not limited to, spring-loaded tabs, pins, locking rings, plunger buttons, clasps, etc., and may be designed to be easily locked into place or released. Additionally, the present disclosure may be configured to be of varying weights and sizes to accommodate different skill and strength levels of different users. Each hemisphere may be configured such that additional weights may be added or subtracted. The additional weights may be of various materials and designed to be easily locked into place or removed.

Figure 1:
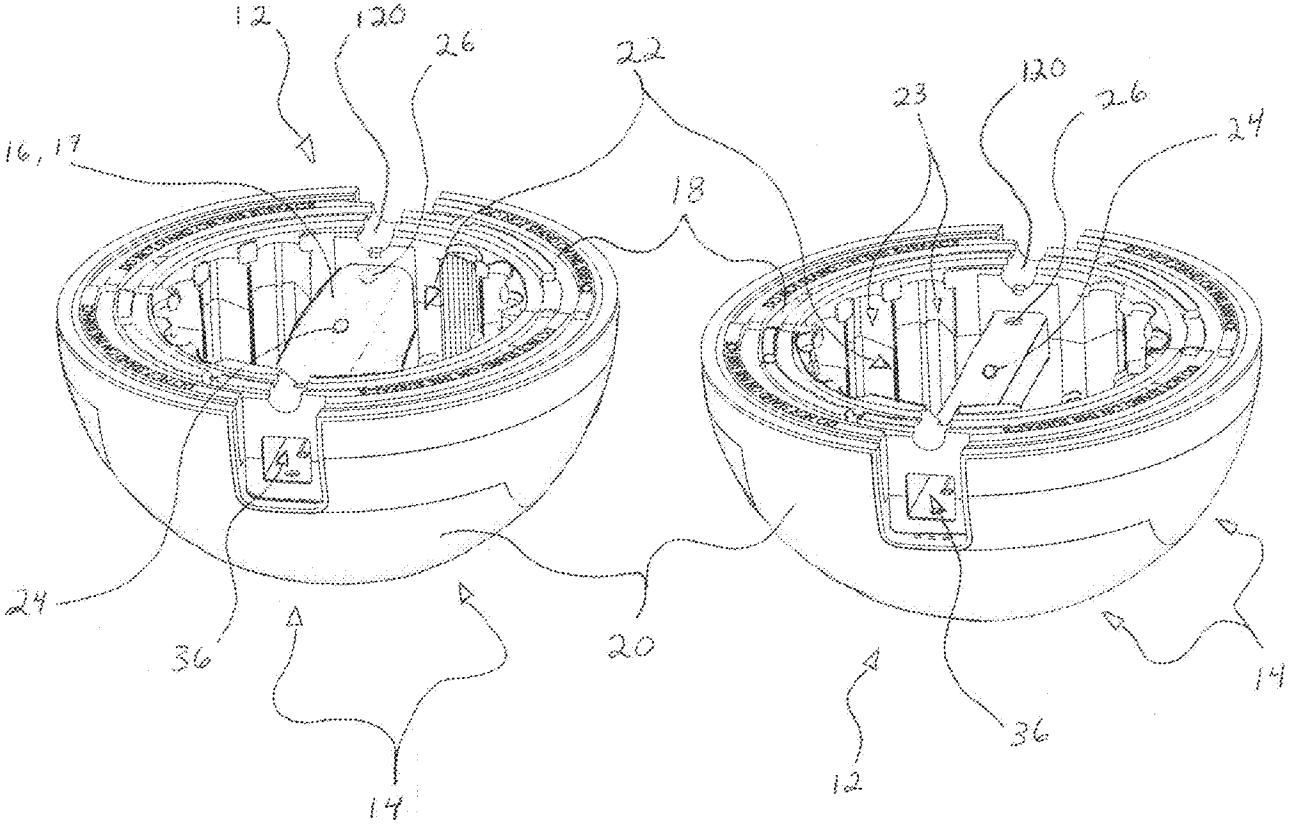
FIG. 1 shows a perspective view of a pair of hemispherical push-up exercise devices according to an embodiment of the present disclosure.

Turning to FIG. 1, an example embodiment of the exercise device is shown. The exercise device may be comprised of two identical hemisphere elements 12 with a main body element 14 and a horizontal cross member 16 acting as a handle with or without a padded hand grip 17. The main body element 14 includes a flat grooved surface 18, a rounded outer surface 20, and a large recessed centralized cavity 22 to allow the user to reach inside the main body element 14 to access the horizontal cross member 16. The horizontal cross member 16 traverses the large recessed centralized cavity 22 and the main body element 14 to form a handle for the user that may be positioned below a center of mass 24 if the entire sphere was present. The positioning of the horizontal cross member 16 below the center of mass 24 increases user safety by decreasing the propensity for the hemisphere elements 12 to roll while being used as a push-up device. The horizontal cross member 16 may be positioned 1/16 inch to 3 inches below the flat grooved surface 18 so as to be below the center of mass 24 and is not intended to be so low as to eliminate the ability of the user to reach around the horizontal cross member 16. As shown in FIG. 1, the horizontal cross member 16 may be of square tubular shape, but in some embodiments, the horizontal cross member 16 may be of other alternative tubular shapes, including triangular, round, square, hexagonal, anatomical, etc. Flat grooved surface 18 may also be configured with one or more grooves for the accommodation of various exercise attachments, such as a pair of grooves 120. In some configurations, the flat grooved surface 18 may be further recessed with a pair of shallow indentations on opposite sides of the inner edges of the large recessed centralized cavity 22 to allow an electronic device, or alternatively, an electronic device holder, to securely attach to the top of the flat grooved surface 18.

Alternative embodiments of the hemisphere element 12 may include variations in the configuration of the main body element 14, flat grooved surface 18, rounded outer surface 20, horizontal cross member 16, and large recessed centralized cavity 22.

The main body element 14 may comprise of a solid material, or alternatively be a hollow shell, a compartmentalized shell, an inflated shell, or a hollow, compartmentalized shell, or an inflated shell. In some embodiments, the shell may be completely or partially filled with materials to add strength or weight. Additionally, the main body element 14 may comprise of a rigid or pliable surface. The rounded outer surface 20 and the flat grooved surface 18 of the main body element 14 may comprise of various combinations of the above stated variations.

Figure 4:
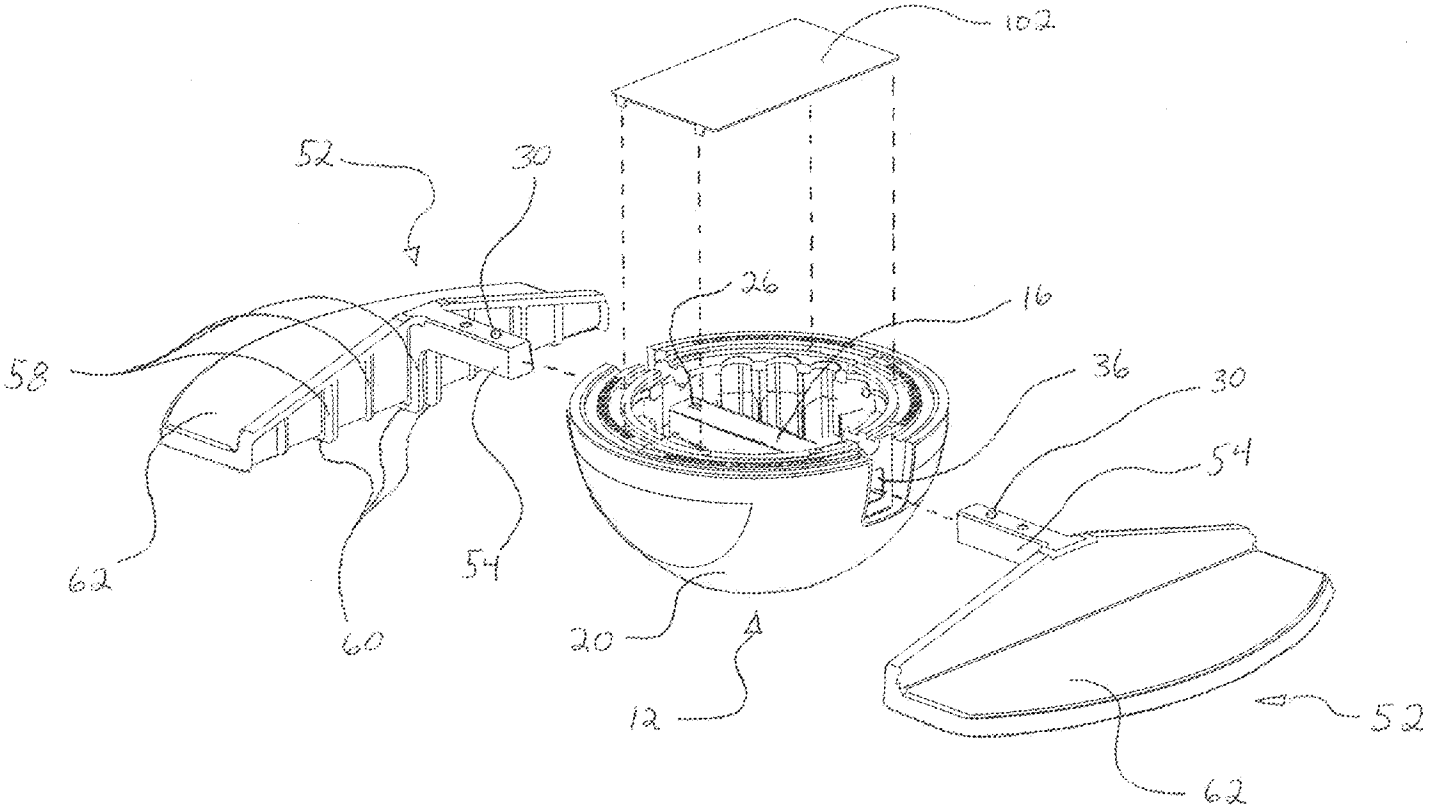
FIG. 4 shows a partially expanded perspective view of a single hemispherical push-up exercise device with foot plate attachments, according to an embodiment of the present disclosure.
Figure 5:
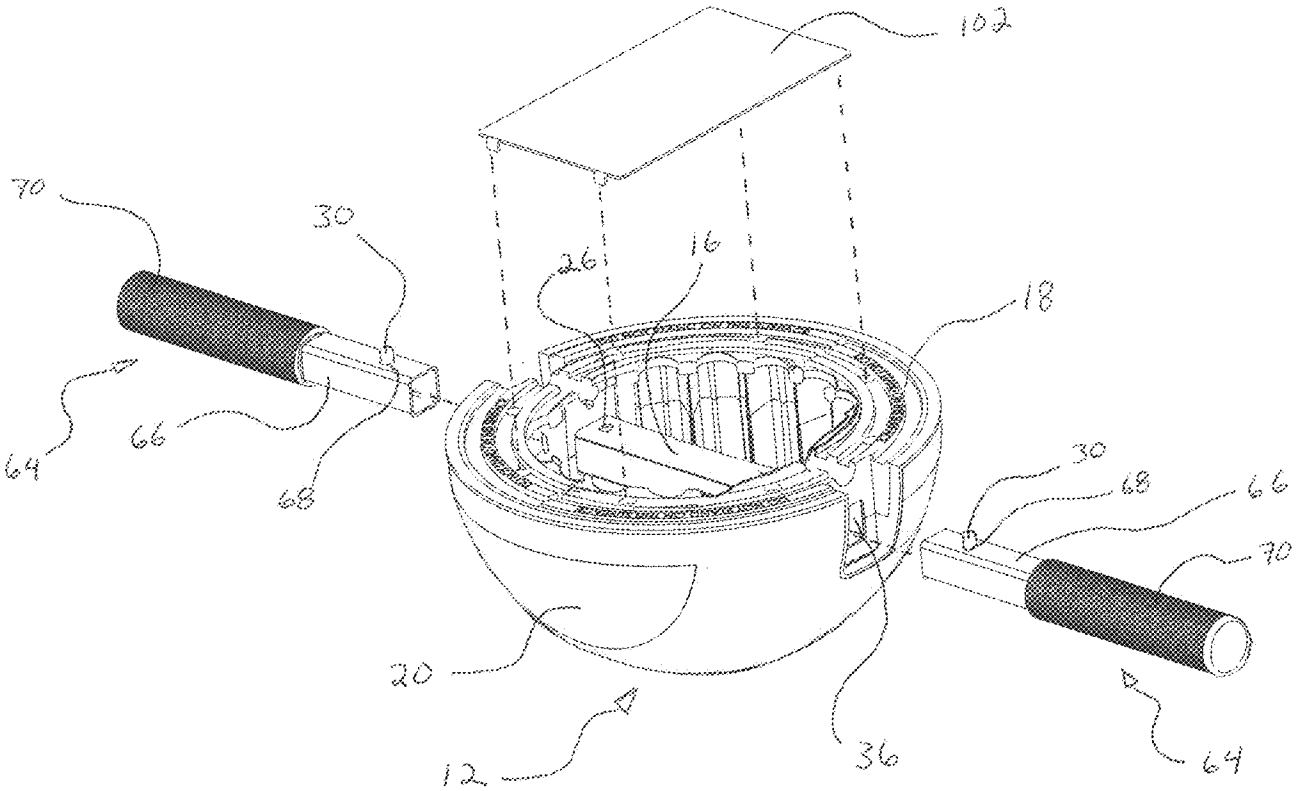
FIG. 5 shows a partially exploded perspective view of a single hemispherical push-up exercise device with a pair of handle bar attachments, according to an embodiment of the present disclosure.

The flat grooved surface 18 may comprise of alternately shaped surfaces including, but not limited to, various shapes or sizes of nodules, various orientations of grooves (parallel, rayed, etc.), textured, etc. In addition, the flat grooved surface 18 may also be configured to accept attachments for electronic devices such as a non-skid device plate 102 as illustrated in FIGS. 4 and 5.

The flat grooved surface 18 may include multiple small apertures that may accept multiple attachment fasteners for adhering the flat grooved surface 18 to the rounded outer surface 20, and grooves 120 for including attachments to the medicine ball configuration 42.

In some embodiments, the horizontal cross member 16 may include smaller apertures for accommodating tabs to fasten the horizontal cross member 16 between the flat grooved surface 18 and rounded outer surface 20. Additionally, the bottom of the large recessed centralized cavity 22 may comprise of a rib cover to provide a smooth surface to the bottom of the large recessed centralized cavity 22.

The rounded outer surface 20 may comprise of various arced dimensions, including multiple arced dimensions within a single embodiment of the rounded outer surface 20, to provide variations in rolling quality and instability. Additionally, the rounded outer surface 20 may also comprise of a rubberized over-molding material, etc., to alter the coefficient of friction or vary the amount of grip for the user. In some examples a coating or other surface treatment may be used to vary the surface texture.

The horizontal cross member 16 may comprise of various shapes such as triangular, square, hexagonal, anatomical, bulbous, etc. Additionally, the cross member 16 may be various textures to increase or decrease user grip. Furthermore, the horizontal cross member 16 may alternatively be a solid structure, a hollow structure, a shell, or a compartmentalized inflated shell wherein the compartmentalized shell is hollow or filled completely or partially with various materials to add strength or weight. Alternatively, the horizontal cross member 16 may comprise of a rigid or pliable material. Each horizontal cross member 16 may contain more than a pair of locking apertures 26, also referred to as smaller apertures, to accommodate different attachment locking components.

Figure 8:
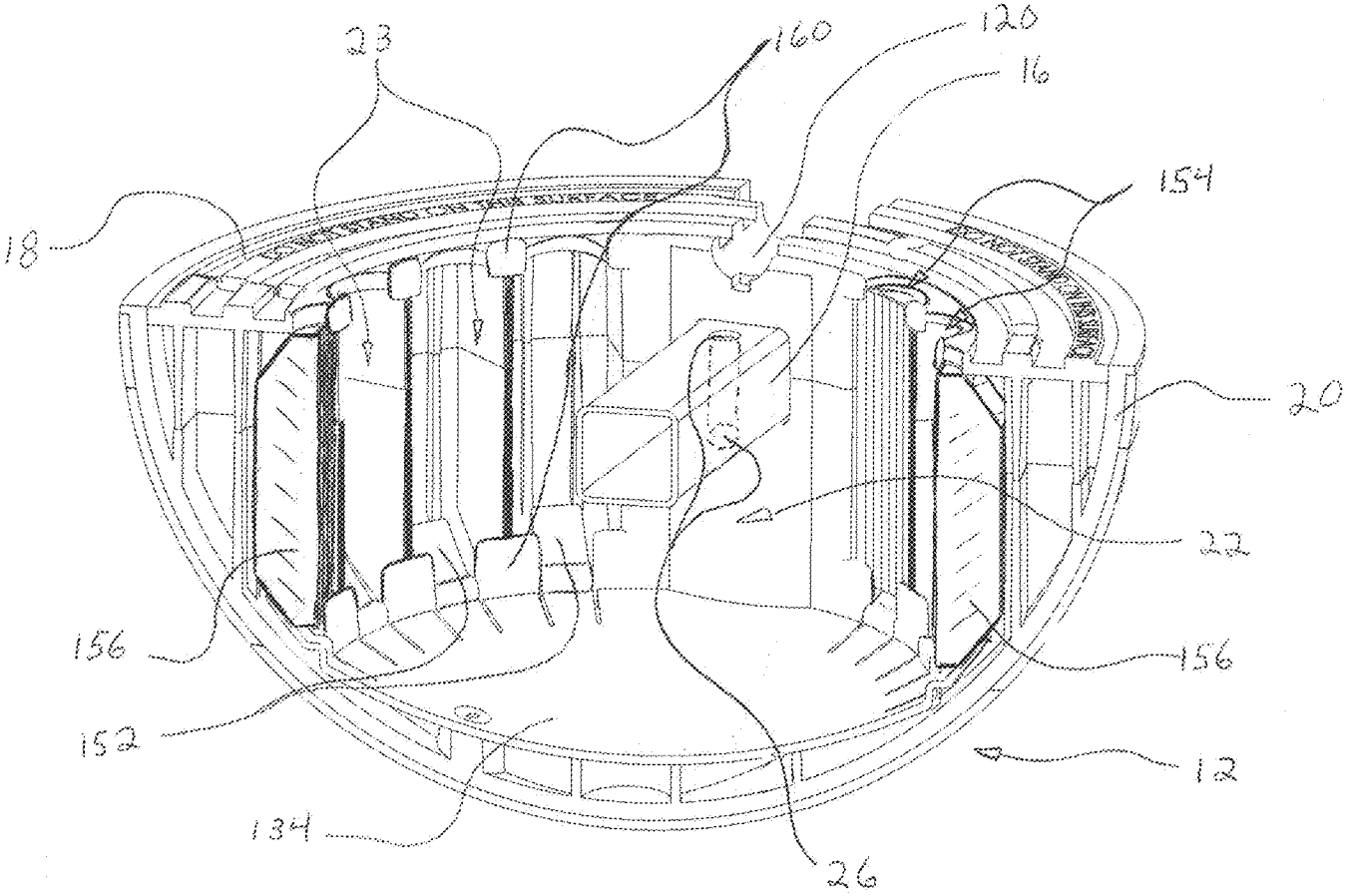
FIG. 8 shows an enlarged, cross sectional view of one hemispherical push-up device illustrating a weight variation system, according to an embodiment of the present disclosure.

The large recessed centralized cavity 22 may be of various shapes such as square, hexagonal, oval, etc. Additionally, the large recessed centralized cavity 22 may be of various depths as long as the intended function of the large recessed centralized cavity 22 to allow access to the horizontal cross member 16 is maintained as described above. Furthermore, the large recessed centralized cavity 22 may be comprised with a plurality of small recessed lateral cavities 23 configured to house additional weighted members 156 as illustrated in FIG. 8. Yet another modification of the large recessed centralized cavity 22 may be the addition of a rib cover plate 134 for providing a smooth surface to the bottom of the large recessed centralized cavity 22 as illustrate in FIG. 8. Additionally, the rib cover plate 134 may be comprised with lateral spring plates 152 for assisting in the locking and removal of said optional weighted members 156 as illustrated in FIG. 8.

Figure 2:
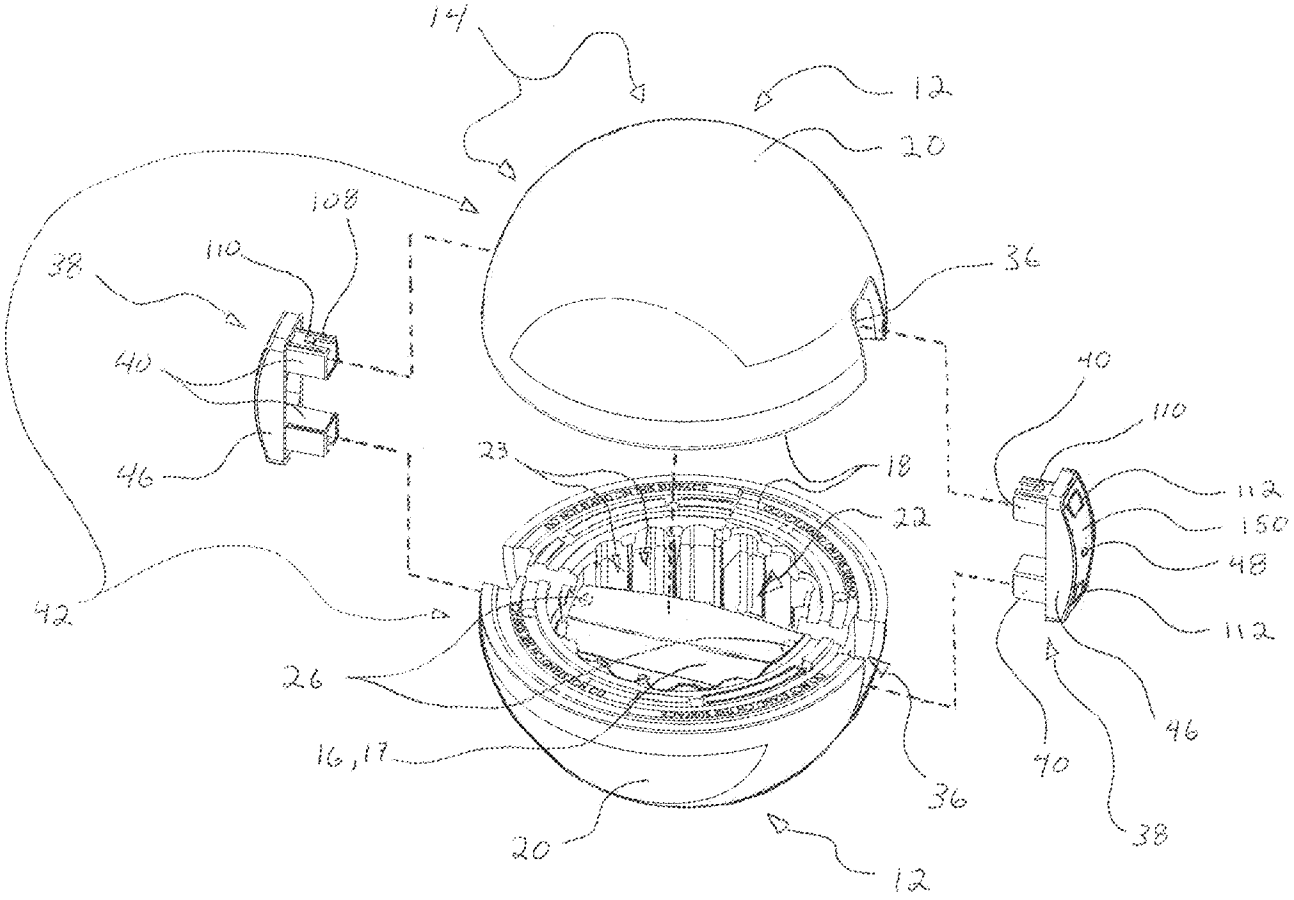
FIG. 2 shows an expanded, perspective view of the pair of hemispherical push-up exercise devices held together by a U-shaped locking mechanism, forming a medicine ball, according to an embodiment of the present disclosure.
Figure 3:
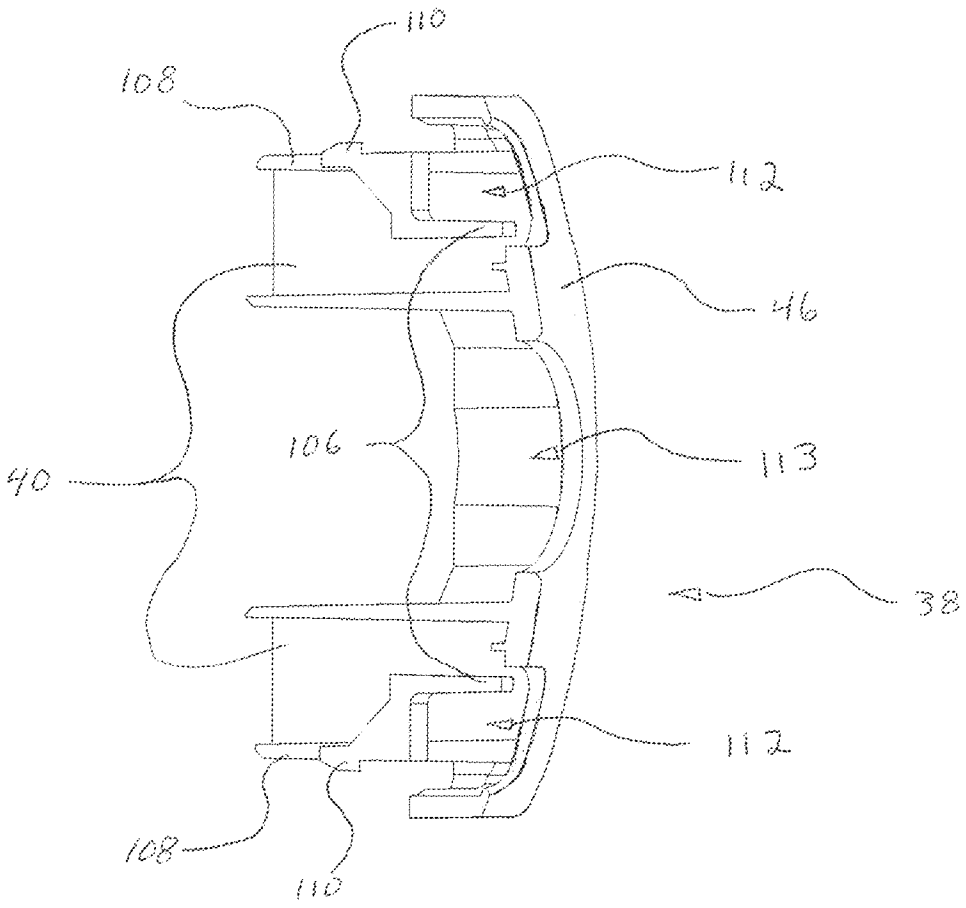
FIG. 3 shows an enlarged cross-sectional view of the U-shaped locking mechanism with a pair of recessed levers used to lock together the two hemispherical push-up exercise devices, according to one embodiment of the present disclosure.
Figure 12:
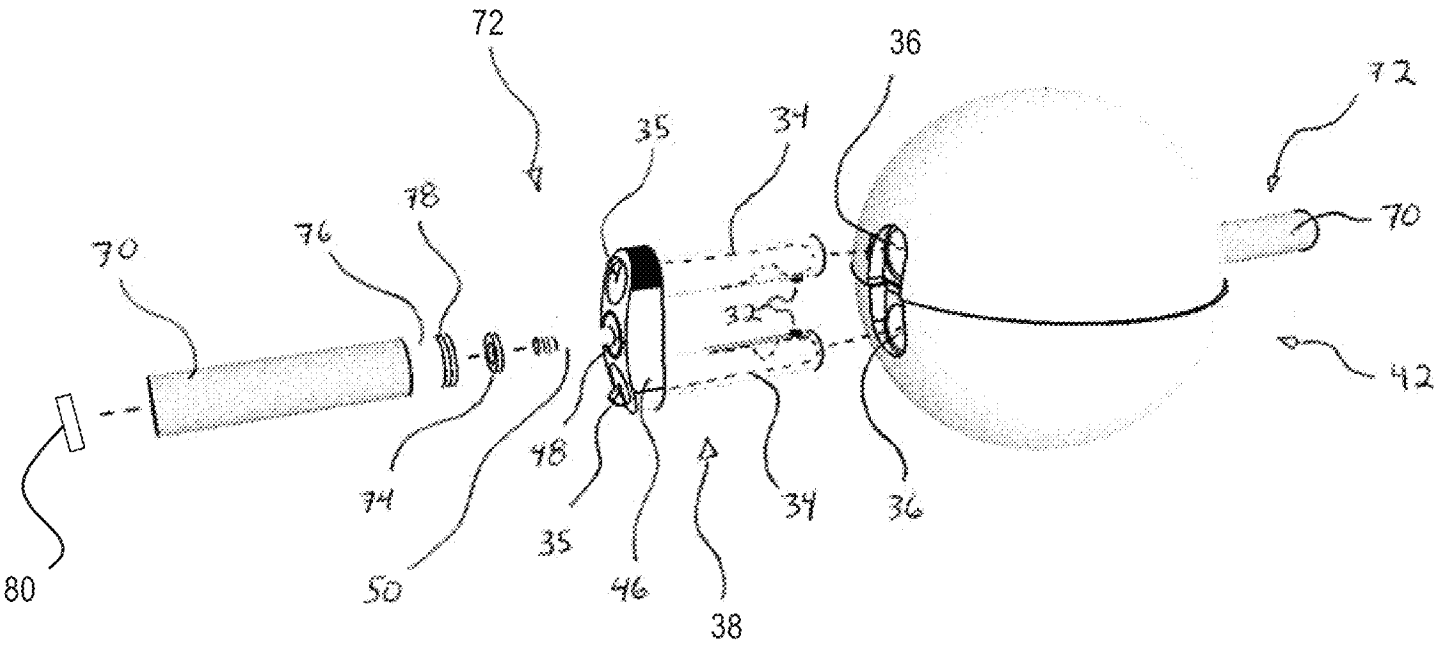
FIG. 12 shows a partially exploded perspective view of an alternate configuration of the medicine ball configuration with a spinning handle bar attachment, according to an embodiment of the present disclosure.
Figure 13:
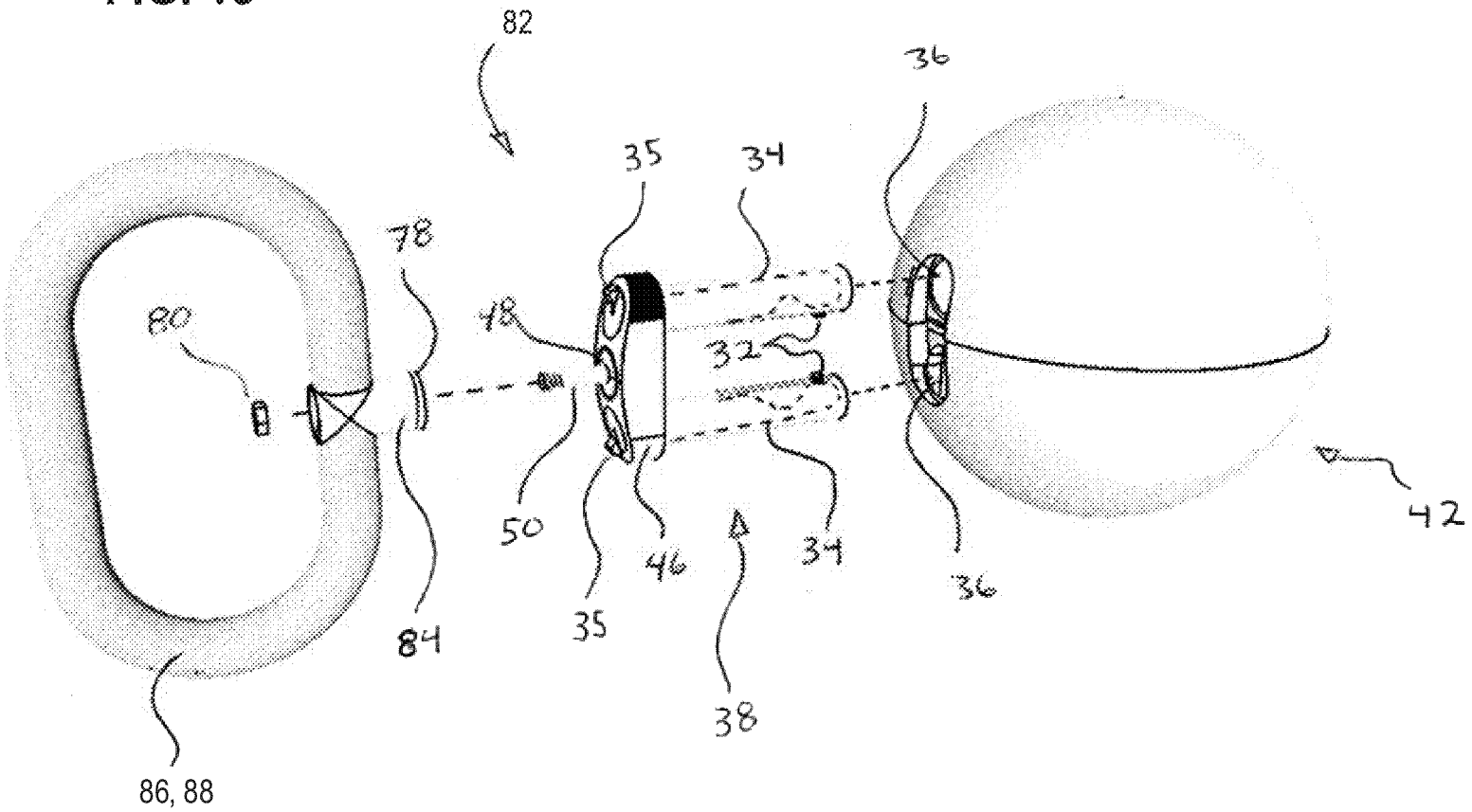
FIG. 13 shows an exploded perspective view of an alternate configuration of the medicine ball configuration including the kettlebell handle attachment with another example U-shaped locking mechanism, according to one embodiment of the present disclosure.
Figure 14:
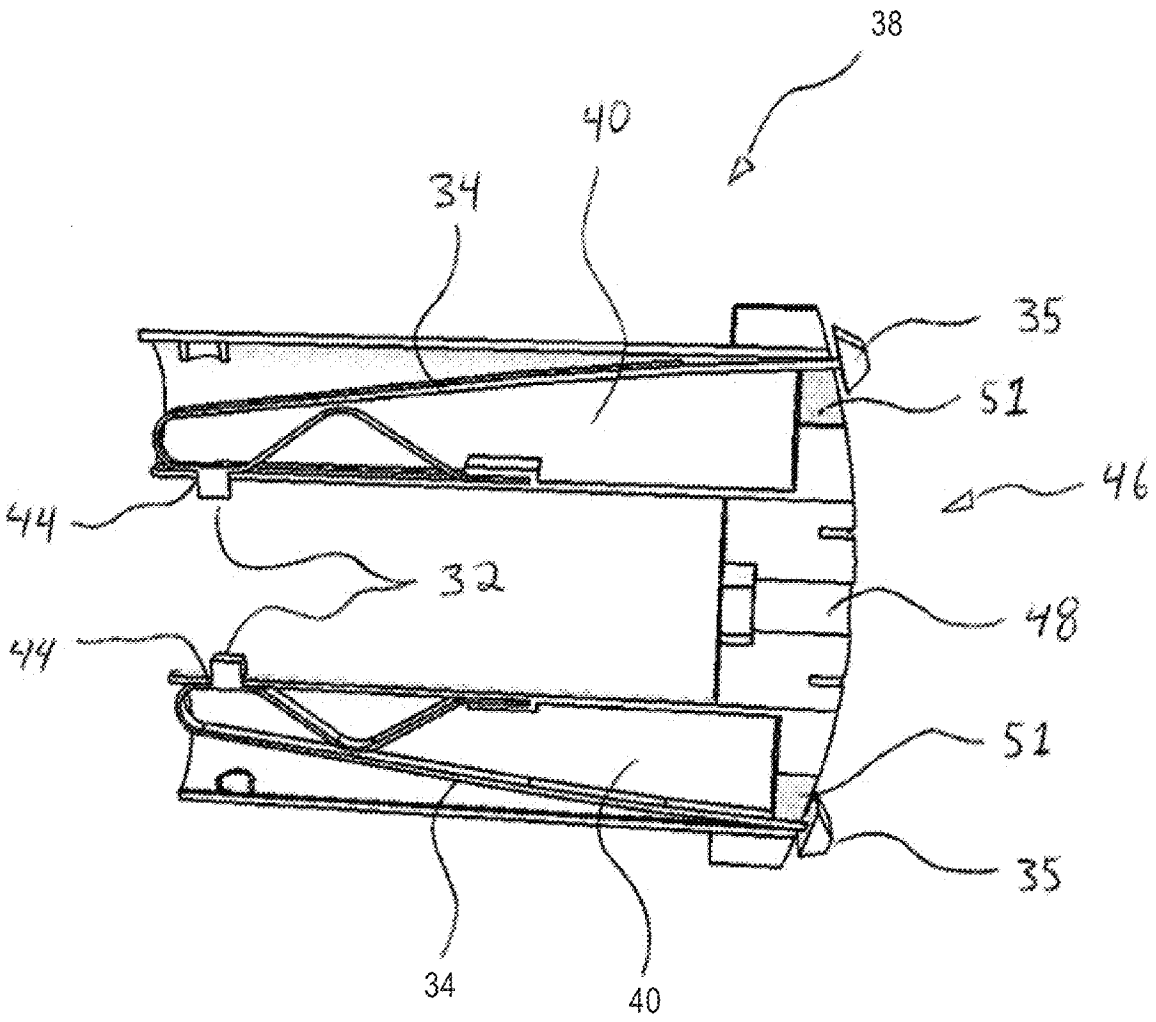
FIG. 14 shows an enlarged, cross sectional view of the U-shaped locking mechanism with spring-loaded push buttons and actuator levers used as an alternative means of securing the U-shaped locking mechanism into the medicine ball configuration, according to an embodiment of the present disclosure.

Turning now to FIG. 1, each horizontal cross member 16 may include the pair of locking apertures 26 that may be positioned to accept a locking mechanism such as a locking tab 110 on spring mechanism 108 (as illustrated in FIG. 3), spring-loaded ball plunger, a-spring-loaded push button, a spring-loaded button 32 with an actuator lever 34 and a finger tab 35 (as illustrated in FIG. 14), a spring-loaded button with a finger tab recessed lever, or other locking device. Each horizontal cross member 16 may also contain a pair of attachment apertures 36, also referred to as larger apertures. Each of the pair of attachment apertures 36 may be located at each terminus that may extend to and conjoin with the rounded outer surface 20 of the main body element 14. The pair of attachment apertures 36 may accommodate a pair of arm portions 40 of an U-shaped locking mechanism 38 as illustrated in FIGS. 2, 3, 6, 7, 10, 12, 13, and 14, an arm segment 54 for each of a pair of foot plate attachment 52 illustrated in FIGS. 4 and 11, and a shaft portion 66 of a pair of handle bar attachments 64 illustrated in FIG. 5.

The pair of hemisphere elements 12 may comprise of material strong enough to handle the stresses of the exercise device, including, but not limited to, plastic, metal, carbon fiber, fiberglass, or rubber material. In some embodiments, each main body element 14 may be solid, hollow, compartmentalized, or alternatively a shell filled completely or partially with various materials to vary the weight of the hemisphere elements 12. Additionally, the hemisphere elements 12 may be overlaid with rubber or neoprene sheath to add grip to the device. The rubber overlay may be confined to the rounded outer surface 20 of each main body element 14, the horizontal cross member 16, or both. In addition, the horizontal cross member 16 may comprise of materials including but not limited to, plastic, metal, carbon fiber or fiberglass. Also, the pair of hemisphere elements 12, may comprise of carbon fiber, fiberglass, metal, or similar material, and may be compression molded into the described shape. Alternatively, a separate compression molding may be used to conjoin the flat grooved surface 18 with the large recessed centralized cavity 22, the rounded outer surface 20, and the horizontal cross member 16 of each hemisphere element 12. Each compression mold may then be conjoined by fasteners, adhesive, fiberglass or carbon fiber wrapping of the seam, or, in case of metal, welded together, or some other form of adhesion. Furthermore, the pair of hemisphere elements 12, may comprise of plastic or rubber, and may be configured by injection molding techniques. Injection molding may allow the hemisphere elements 12 to be a single piece, or several pieces that may then be adhered together. In some embodiments, the horizontal cross member 16, may comprise of a different material than the main body element 14, and may be added to the main body element 14 through adhesion or the main body element 14 may be injection molded around the horizontal cross member 16.

Turning now to FIG. 2, an example embodiment is illustrated showing the conjoining of the two identical hemisphere elements 12, using a pair of U-shaped locking mechanisms 38, into a single medicine ball configuration 42. Each locking mechanism may include the pair of arm portions 40, a spring mechanism 108 with a locking tab 110 cut or molded within said arm portion 40, a base element 46 with a small centralized component connection aperture 48 for accommodating a protective cover 150, and two medium apertures 112 that may allow access to a pair of finger tab recessed levers 106 of each said arm portion 40. The U-shaped locking mechanism 38 may be inserted into the single medicine ball configuration 42 by pressing or squeezing the pair of finger tab recessed levers 106, allowing clearance of the locking tab 110 as each arm portion 40 is inserted into the horizontal cross member 16 until said locking tab 110 can engage with the pair of locking apertures 26 of each horizontal cross member 16. The U-shaped locking mechanism 38 may be removed in the reverse manner of squeezing the pair of finger tab recessed levers 106 of each arm portion 40 until each locking tab 110 is disengaged from the locking apertures 26 of each horizontal cross member 16 allowing each said arm portion 40 to traverse said horizontal cross member 16 until removed from the single medicine ball configuration 42. The arm portions 40 of the U-shaped locking mechanism 38, as illustrated in FIG. 2, may be square tubular in shape. Alternatively, in some embodiments, the arm portions 40 may be of any tubular shape including, but not limited to, triangular, round, square, hexagonal, etc., that may coincide with the shape of the attachment aperture 36 and horizontal cross member 16 of the hemisphere elements 12. To transform the pair of hemisphere elements 12 into a medicine ball configuration 42, as a first step the flat grooved surface 18 of the main body element 14 may be seeded together so that the attachment aperture 36 of the horizontal cross member 16 may be adjacent to each other. Then, the arm portions 40 of the locking mechanism 38 may be inserted into the attachment aperture 36 of the horizontal cross member 16 and slid inward until the locking apertures 26 of the horizontal cross member 16 accept the locking tab 110. In some embodiments, the rounded outer surface of each base element 46 may be congruous with the rounded outer surface 20 of the main body element 14 when the locking mechanism 38 is fully inserted.

Alternate embodiments of the U-shaped locking mechanism 38 may include variations to the arm portions 40 and base element 46.

The arm portions 40 of the U-shaped locking mechanism 38 may comprise of various lengths and shapes while still achieving the intended function of the embodiment. Further, the arm portions 40 may comprise of solid material, or may be alternatively configured as a hollow shell, or a compartmentalized shell, or an inflated shell, or a hollow, compartmentalized shell, or an inflated or a shell filled completely or partially with various materials to add strength or weight.

The arm portions 40 may comprise various alternative locking components including, but not limited to, ball plungers, spring-loaded buttons, key activated locking pins, locking rings, locking levers, locking grooves (spring-loaded plunger ball or locking ring incorporated into the horizontal cross member 16 that would engage into said groove), magnets, locking tumblers, etc. Furthermore, the base element 46 may comprise of alternative apertures, grooves, keyholes, etc., to coincide with alternative locking components.

The base element 46 of the U-shaped locking mechanism 38 may comprise of solid material, or alternatively configured as a hollow shell, a compartmentalized shell, an inflated shell, or a hollow, compartmentalized shell. Additionally, the base element 46 may comprise of an inflated shell, or a shell filled completely or partially with various materials to add strength or weight. Still further, the base element 46 may be configured to have various sized and shaped apertures in addition to, or in lieu of the two grooves 51 (shown in FIG. 10), medium apertures 112, and the centralized component connection aperture 48, also referred to as a component connection aperture, including, but not limited to, apertures for accommodating various locking components, apertures for assisting in disengaging the locking components, apertures for allowing attachments to traverse the base element 46, apertures for providing a means for gripping the base element 46, apertures for accommodating the attachment of over-molding to the base element 46 such a cover, for example, etc. The base element 46 may comprise of a rigid or semi-rigid material of various textures to modify the user's grip of the base element 46. The base element 46 may be covered with various materials including, but not limited to, rubber, plastic, foam, etc., to vary the amount of grip provided to the user of the device.

FIG. 3 illustrates an enlarged, cross-sectional view of one half of the U-shaped locking mechanism 38 with large centralized aperture 113 (for use with spinning handle bar attachment 72 and kettlebell handle attachment 82) replacing the small centralized component connection aperture 48 as one example of an alternate embodiment of the U-shaped locking mechanism 38 as illustrated in FIG. 2. The U-shaped locking mechanism 38 includes the base element 46, and a pair of arm portions 40 configured to fit into an attachment aperture 26 of horizontal cross member 16. Each base element 46 may include a small centralized component connection aperture 48 to affix a protective cover (as shown in FIG. 2), or a large centralized aperture 113 for use with various exercise attachments. Additionally, each arm portion 40 may include a spring mechanism 108 with a locking tab 110 and finger tab or recessed lever 106 cut or molded within said arm portion 40. The spring mechanism 108 may be of various sizes and tensions of spring to accommodate multiple applications. Each locking tab 110 may be positioned on the outside of each of the arm portions 40, and configured to intersect with the locking apertures 26 of the horizontal cross member 16 of the hemisphere elements 12 illustrated in FIGS. 1-2 when the locking mechanism 38 is fully inserted. In some embodiments, both the locking tab 110 of the spring mechanism 108 on the arm portions 40, and the locking apertures 26 on the horizontal cross member 16, may be positioned to any location on the arm portions 40 and cross member 16, while still configured to lock the pair of hemisphere elements 12 together. Locking tabs 110 may be disengaged from the pair of locking apertures 26 of the horizontal cross member 16 by pressing or squeezing the pair of finger tab recessed levers 106.

The pair of locking mechanism 38 may comprise of any material strong enough to handle the stresses of the exercise device, including, but not limited to, plastic, metal, carbon fiber, fiberglass, or rubber material. Also, the locking mechanism 38 may comprise of carbon fiber, fiberglass, metal, or similar material, and may generally be compression molded into a shape similar to that illustrated in FIG. 2. A separate compression may be required for each arm portion 40, and the base element 46. In one embodiment, compression mold may be conjoined by fasteners, including, but not limited to: screws, adhesive, fiberglass or carbon fiber wrapping of the seam. In further embodiments, when the locking mechanism comprises of metal or other suitable material, the compression mold may be welded together, or some other form of adhesion. In some embodiments, each locking mechanism 38, may comprise of plastic or rubber, and may be configured using injection molding techniques. Injection molding may allow each locking mechanism 38 to be configured as a single piece, or several pieces that may then be adhered together. Still further, the arm portions 40, may comprise of a different material than the base element 46, and may be added to the base element 46 through adhesion or the base element 46 may be injection molded around the arm portions 40.

Alternatively, in lieu of locking tab 110, U-shaped locking mechanism 38 may include a spring-loaded button 32 with an actuator lever 34 that may traverse the two grooves 51 on the base element 46. This configuration may allow the user to unlock the U-shaped locking mechanism 38 remotely from the outside. A finger tab 35 may be coupled to actuator lever 34 as illustrated in FIGS. 12, 13, and 14.

In other embodiments, each U-shaped locking mechanism may include a small aperture on each arm portion 40 and a spring-loaded ball plunger recessed inside each small aperture. Each arm portion 40 may include the small apertures for accommodating a spring-loaded ball plunger and a spring-loaded push button. Alternatively, each arm portion 40 may include the small apertures for accommodating the spring-loaded button with the actuator lever with the finger tab as described above. The spring-loaded ball plunger and spring-loaded push button may include various sizes and tensions of spring to accommodate multiple applications. Each small aperture may be positioned on the inside of each of the arm portions 40, and configured to intersect with the locking apertures 26 of the horizontal cross member 16 of the hemisphere elements 12 when the locking mechanism 38 is fully inserted. In some embodiments, both the small apertures of the arm portions 40 and the locking apertures 26 on the horizontal cross member 16 may be positioned to any location on the arm portions 40 and cross member 16, while still configured to lock the pair of hemisphere elements 12 together.

FIG. 4 illustrates an example embodiment for a pair of foot plate attachments 52 that may be attached to the hemisphere elements 12 to provide a lower extremity balancing apparatus. Each of the foot plate attachments 52 includes an arm segment 54, the spring-loaded push button 30 traversing a small aperture 56 on the arm segment 54, one or more vertical stay portions 58, one or more horizontal stay portion 60, and a foot plate 62. The spring-loaded push button 30 may be aligned with the locking apertures 26 of the horizontal cross member 16 of the hemisphere elements 12 when the arm segment 54 of the foot plate attachment 52 is fully inserted into the attachment aperture 36 of the horizontal cross member 16 of the hemisphere elements 12, thus locking it in position. In one embodiment, the small aperture 56 of the arm segment 54 and the locking apertures 26 on the horizontal cross member 16 may be positioned to align at any location on the arm segment 54 and horizontal cross member 16, while achieving the intended function of locking the foot plate attachments 52 to the hemisphere elements 12. In one embodiment, the arm segments 54 of the foot plate attachments 52 may be tubular in shape. In further embodiments, the arm segments 54 may be of any shape including triangular, round, square, hexagonal, etc. that may coincide with the shape of the attachment aperture 36 and horizontal cross member 16 of the hemisphere elements 12. Additionally, the flat grooved surface 18 of the hemisphere element 12 may be configured with a non-skid device plate 102 for accommodating various electronic devices, or may be alternatively used as hand, foot, or elbow placement surface while using the foot plate attachments 52. The foot plate attachment 52 may be configured to be of varying height from the floor, or alternatively, may be configured to be of adjustable height.

Alternate embodiments of the foot plate attachment 52 may include variations to the arm segments 54, vertical stay portions 58, horizontal stay portions 60, and foot plates 62. In further embodiments, the vertical stay portions 58 and the horizontal stay portions 60 may be configured to be of varying lengths.

In further embodiments, the arm segments 54 may comprise of various lengths and shapes while still completing the intended function of the embodiment. Additionally, the arm segment 54 may comprise of solid material, or alternatively, be a hollow shell, a compartmentalized shell, or a shell filled completely or partially with various materials to increase strength or weight. The arm segments 54 may be configured to spin within the horizontal cross member 16, or external to the horizontal cross member 16 to provide an alternate level of instability to the foot plate attachment 52.

The vertical stay portion 58 may comprise of one or multiple vertical stay portions 58 to add stability to the foot plate attachment. The vertical stay portion 58 may be configured of different shapes including, but not limited to, round, flat, square, triangular, hexagonal, etc. Additionally, the vertical stay portion 58 may comprise of solid material, or alternatively be, a hollow shell, a compartmentalized shell, or a shell filled completely or partially with various materials to increase strength or weight. In some embodiments, the vertical stay portion 58 may comprise of varying lengths, or may be configured to adjust in height to vary the difficulty of the exercise.

In further embodiments, the horizontal stay portion 60 may comprise of one or multiple horizontal stay portions 60 to add stability to the foot plate attachment 52. In addition, the horizontal stay portion 60 may be configured of different shapes including, but not limited to, round, flat, square, triangular, hexagonal, etc. Furthermore, the horizontal stay portion 60 may comprise of solid material, or alternatively be a hollow shell, compartmentalized shell, or a shell filled completely or partially with various materials to increase strength or weight. In some embodiments, the horizontal stay portion 60 may comprise of varying lengths, or may be configured to adjust in width for different users. In addition, the horizontal stay portion 60 may comprise of a hand grip accessed through the foot plate 62 to allow the foot plate attachment 52 to be used as a push-up device.

The foot plate 62 may comprise of different shapes, but not limited to, oval, round, square, rectangular, quadrilateral, anatomical, etc. Additionally, the foot plate 62 may comprise of a solid material, a hollow shell, a compartmentalized shell, or a shell filled completely or partially with various materials to increase strength or weight. In some embodiments, the foot plate 62 may be configured to adjust in length or width to adapt to different users. In further embodiments, the foot plate 62 may comprise of a rigid or semi-rigid material, and may be configured with padded, textured, or aperture surfaces. In some embodiments, the foot plate 62 may be configured to make a continuous concentric ring around the medicine ball configuration 42. Additionally, the foot plate 62 may be configured to represent various pieces of sporting equipment including, but not limited to a skate board, snow board, surf board, skis, racing wheel, etc. In some embodiments, the foot plate 62 may comprise a hand grip, or series of hand grips, to provide alternate push-up, or upper body stability exercises.

The foot plate attachments 52 may comprise of, but not limited to, plastic, metal, carbon fiber, or fiberglass material. Additionally, the foot plate attachments 52 may be configured into the shape illustrated in FIG. 4 by cutting, shaping, welding, compression molding, or injection molding. A separate component may further comprise the foot plate 62, the arm segment 54, the vertical stay portion 58, the horizontal stay portion 60, and the foot plate 62. In some embodiments, the vertical stay portion 58, horizontal stay portion 60, and foot plate 62 may be configured as a single-piece. Additionally, the components, if made separately, may then be secured together by bolting, welding, carbon fiber wrapping, or some other form of adhesion. The foot plate attachments 52, may comprise of plastic material, and may be configured to the shape illustrated in FIG. 4 by injection molding. The arm segment 54, the vertical stay portion 58, the horizontal stay portion 60, and the foot plate 62 may be configured as separate injection molds and conjoined by bolting or other forms of adhesion, or configured as a single injection molded piece.

FIG. 5 illustrates an example embodiment for the a pair of handle bar attachments 64 that may be attached to the hemisphere elements 12 to allow for a wide grip push-up exercise with the hemisphere elements 12 acting as a single destabilizing fulcrum. The pair of handle bar attachments 64 include a bar portion or shaft portion 66 with a small aperture 68 that may attach the spring-loaded push button 30, and a padded handle grip 70. Furthermore, the small aperture 68 with the spring-loaded push button 30 is configured to be aligned with the locking apertures 26 of the horizontal cross member 16 of the hemisphere elements 12, which may lock the handle bar attachment 64 in place when fully inserted. In addition, the spring-loaded push button 30 may be manually disengaged when the user wishes to remove the pair of handle bar attachments 64. Although the shaft portion 66 of the handle bar attachments 64 is illustrated in FIG. 5 as a square tubular shape, the shaft portion 66 may be of any shape including, but not limited to, triangular, square, hexagonal, etc., that may coincide with the shape of the attachment aperture 36 and horizontal cross member 16 of the hemisphere elements 12, or complete the intended function of the embodiment. Additionally, the flat grooved surface 18 of the hemisphere element 12 may be configured with a non-skid device plate 102 for accommodating various electronic devices, or may be alternatively used as hand, foot, or elbow placement surface while using the handle bar attachments 64.

Alternate embodiments for the handle bar attachments 64 may include, but are not limited to, variations in shape or length while still completing the intended function of the embodiment. In some embodiments, the handle bar attachments 64 may be configured to represent various pieces of equipment including, but not limited to, motorcycle handle bars, jet ski handle bars, water sport handle, gymnastics bars, weight lifting bars, martial arts equipment, paddles, racing wheel, ski poles, etc. Additionally, the handle bar attachments 64 may comprise of a rigid or semi-rigid material, and may be configured alternatively, with a textured, padded, or anatomically matching surface. Furthermore, the handle bar attachments 64 may comprise of solid material, or alternatively configured as a hollow shell, a compartmentalized shell, or a shell filled completely or partially with various materials to increase strength or weight.

Each shaft portion 66 of the handle bar attachments 64 may comprise of but not limited to, metal, plastic, carbon fiber, or fiberglass material. The shaft portion 66 of the handle bar attachments 64, if made of metal, may be configured by cutting pre-formed metal tubing and adding a spring-loaded push button 30 and padded handle grip 70. Further, the handle bar attachments 64, may comprise of carbon fiber, fiberglass, plastic, or other material, and may be compression molded or injection molded, either with or without the small aperture 68, and then may be drilled for the small aperture 68, and fitted with the spring-loaded push button 30 and the padded handle grip 70. The padded handle grip 70 may alternatively comprise of rubber, neoprene, foam, or other padded material.

Figure 6:
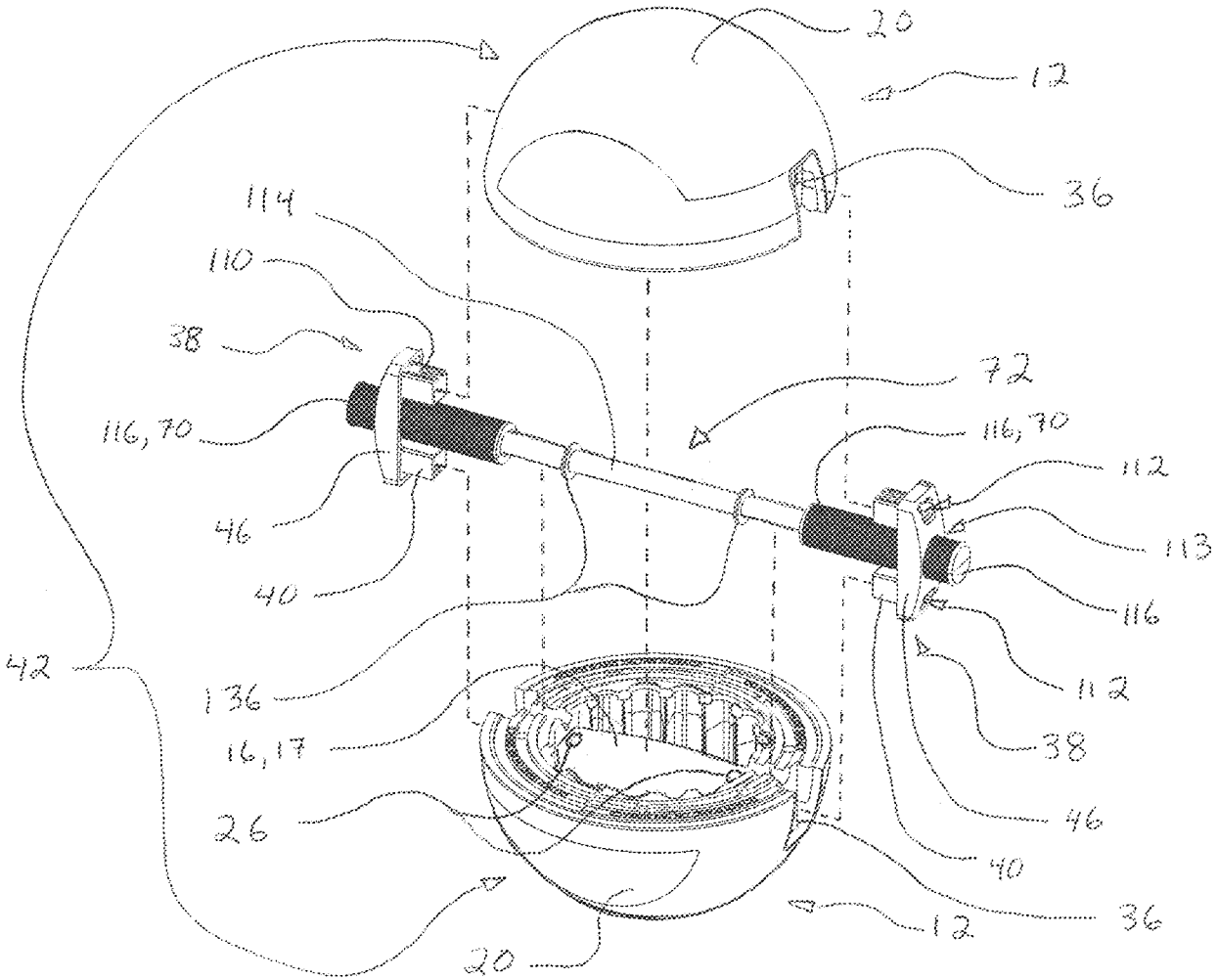
FIG. 6 shows a partially exploded perspective view of the medicine ball configuration with a spinning handle bar attachment, according to an embodiment of the present disclosure.

FIG. 6 illustrates an example embodiment for a spinning handle bar attachment 72 that may be inserted in the medicine ball configuration 42 to allow for a rolling device. The spinning handle bar attachment 72 traverses the medicine ball configuration 42 through the pair of grooves 120 located on the flat grooved surface 18 of the hemisphere elements 12. The spinning handle bar attachment 72 may comprise of a pair of handle portions 116 with the padded handle grip 70, the rod portion 114, and a pair of washers 136 secured to the rod portion 114 for proper seeding of the spinning handle bar attachment 72 within the flat grooved surface 18. The medicine ball configuration 42 may be held together by the pair of U-shaped locking mechanisms 38 that may slide over the handle portions 116 by traversing the large centralized aperture 113 of the base element 46 of the U-shaped locking mechanism 38. The arm portion 40 of the U-shaped locking mechanism may be configured to insert into the attachment aperture 36 of the horizontal cross member 16 and lock the medicine ball configuration 42 together when the pair of locking tabs 110 on spring mechanism 108 of the pair of U-shaped locking mechanisms 38 traverse the locking apertures 26 of the horizontal cross member 16. The spinning handle bar attachment 72 may be comprised to spin where the rod portion 114 traverses the grooves 120 of the flat grooved surface 18, where the handle portion 116 connects to rod portion 114, or both.

Alternate embodiments for the spinning handle bar attachments 72 may include, but are not limited to, variations to the rod portion 114, U-shaped locking mechanism 38, the handle portion 116, and padded handle grip 70.

Alternate embodiments of the rod portion 114 may include, but are not limited to, various lengths, shapes, or textures. The rod portion 114 may comprise of various materials including plastic, metal, fiberglass, carbon fiber, etc. Further, the rod portion 114 may comprise of a solid material, or alternatively, may be configured as a hollow shell, or a compartmentalized shell, and may be or filled completely or partially with various materials to add strength or weight. Furthermore, the rod portion 114 may comprise of rigid or semi-rigid material and still achieve the intended function of the embodiment. Additionally, the rod portion 114 may comprise of bushings, bearings, liquid membrane, or other means of decreasing friction, located along the length of the rod portion 114 to allow the medicine ball configuration 42 to spin freely on the rod portion 114.

The U-shaped locking mechanism 38 may alternatively be configured to attach directly to separate spinning handle bar attachments without use of the rod portion 114, by means of a bolt attachment through the small centralized aperture of the base element 46 of the U-shaped locking mechanism 38 into the handle portion 116. The U-shaped locking mechanism 38 may alternatively comprise variations in size and shape of apertures to accommodate variations in locking components or attachment methods for the spinning handle bar attachments 72.

Alternate embodiments for the handle portions 116 may include, but are not limited to, the use of ball bearings, or ribbing, or bushings to allow for spinning of the handle portions 116 on the rod portion 114. The bushings may comprise of materials such as plastic. Additionally, a fluid filled medium, or alternative means of lubrication, may be used to reduce friction of the handle portions 116 to the rod portion 114, and still meet the intended function of the embodiment. Further, the handle portions 116 may be adhered to the rod portion 114 by means of weld, adhesive, carbon fiber wrap, or other means of adhesion, allowing the spinning action of the spinning handle bar attachment 72 to occur between the rod portion 114 and each groove 120 of the flat grooved surface 18. Further yet, the handle portion 116 with padded handle grip 70, rod portion 114, and pair of washers 136, may comprise of a single molded piece. Additionally, the handle portions 116 may be secured on the rod portion 114 by a rib portion held within a grooved portion of the rod portion 114. The handle portion 116 may comprise of various shapes and sizes including, but not limited to, round, square, triangular, hexagonal, anatomical, etc. The handle portion 116 may comprise of various materials including plastic, metal, fiberglass, carbon fiber, etc., and may be made of a solid material, hollow shell, compartmentalized shell, or filled completely or partially with various materials to add weight or strength.

The padded handle grip 70 may comprise of various materials including, but not limited to, rubber, neoprene, foam, plastic, etc., and may be of anatomical shape for the hand.

Figure 7:
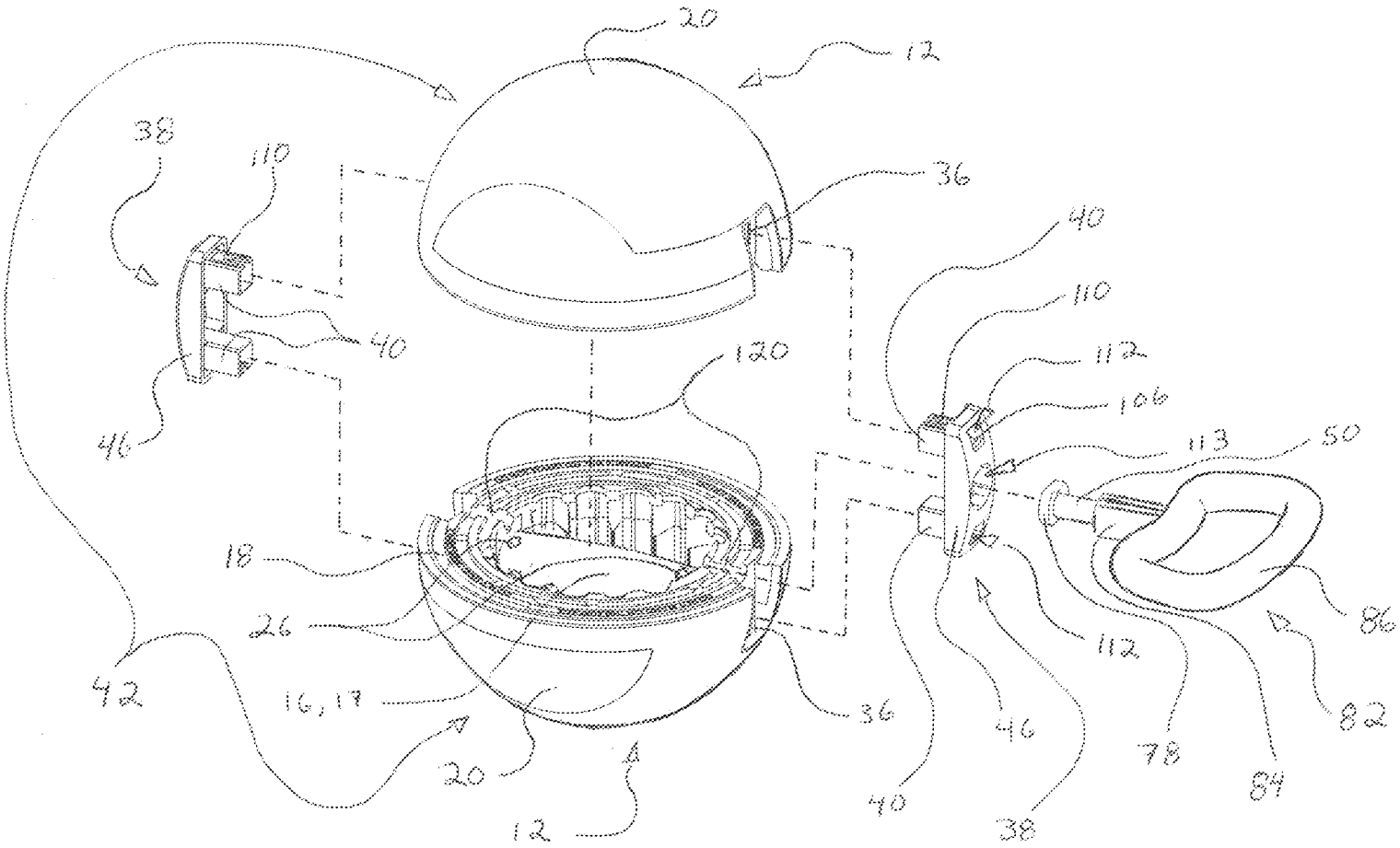
FIG. 7 shows a partially exploded perspective view of a kettlebell handle attachment incorporated with the medicine ball configuration, according to an embodiment of the present disclosure.

FIG. 7 illustrates a possible attachment for the present disclosure that may be referred to as a kettlebell handle attachment 82, named after a commonly understood piece of exercise equipment known as a "kettlebell". A kettlebell includes a large bell-shaped weight with a gripping handle attached to the top of the weight with room for both hands to grip the handle. The kettlebell handle attachment 82 may comprise of the U-shaped locking mechanism 38 with the alternate large centralized aperture 113 of the base element 46 replacing the small centralized component connection aperture 48 to allow the large bar portion 84 to traverse said base element 46. The kettle bell handle attachment 82 may further include a large bar portion 84, a small bar portion 50, a blocking brace portion 78, and a holder portion 86 with padded hand grip 88. The kettlebell handle attachment 82 may be inserted into the medicine ball configuration 42 by placing the small bar portion 50 of the kettlebell handle attachment 82 between the pair of grooves 120 of the flat grooved surface 18 and seeding the two hemisphere elements 12 together. The pair of U-shaped locking mechanisms 38 are locked in position as described in FIG. 2, thus securing the two hemisphere elements 12 together in medicine ball configuration 42. The blocking brace portion 78 is captured inside the pair of large recessed centralized cavities 22 of the medicine ball configuration 42, thus keeping the kettlebell handle attachment 82 from sliding out of said medicine ball configuration 42.

Alternate embodiments for the kettle bell handle attachment 82 may include, but are not limited to, variations to the U-shaped locking mechanism 38, the large bar portion 84, the small bar portion 50, the blocking brace portion 78, the holder portion 86, and padded handle grip 70.

The U-shaped locking mechanism 38 may be configured to move freely over the large bar portion 84 using the alternate large centralized aperture 113 as illustrated in FIG. 7, or attach directly to the large bar portion 84 by means of a bolt, weld, or other form of adhesion. The U-shaped locking mechanism may comprise variations in apertures to accommodate variations in locking components or attachment methods for the kettlebell handle attachment 82.

The large bar portion 84 may comprise of various shapes and sizes including, but not limited to, round, square, triangular, hexagonal, etc. The large bar portion 84 may comprise of a texture or smooth surface, and may be rigid, semi-rigid, or pliable. The large bar portion 84 may comprise of various materials including plastic, metal, fiberglass, carbon fiber, etc., and may be made of a solid material, hollow shell, compartmentalized shell, or filled completely or partially with various material to add weight or strength. The bar portion 84 may be configured to spin through use of a thrust washer, bushing, or other means. The large bar portion 84 may be configured to attach directly to the base element 46 of the U-shaped locking mechanism 38 as illustrated in FIG. 13. The large bar portion 84 may comprise of a single molded piece with the small bar portion 50, blocking brace portion 78, and holder portion 86, or comprise a separate piece attached to the holder portion 86, and small bar portion 50 by means of bolt, screw, weld, carbon fiber wrap, adhesive, or other means of adhesion while still meeting the requirements of the intended embodiment.

The small bar portion 50 may alternatively comprise of different sizes, shapes, or lengths of bolt while still completing the intended function of the embodiment. The small bar portion 50 may comprise of various materials including plastic, metal, fiberglass, carbon fiber, etc. Further, the rod portion 114 may comprise of a solid material, or alternatively, may be configured as a hollow shell, or a compartmentalized shell, and may be or filled completely or partially with various materials to add strength or weight. Furthermore, the rod portion 114 may comprise of rigid or semi-rigid material and still achieve the intended function of the embodiment. The small bar portion 50 may be configured to traverse the grooves 120 on the flat grooved surface 18 of the main body elements 14 while in medicine ball configuration 42 as illustrated in FIG. 7. The small bar portion 50 may alternately be configured to attach the base element 46 of the U-shaped locking mechanism 38 to the large bar portion 84 of the kettlebell handle attachment 82 as illustrated in FIG. 13. The small bar portion 50 may be configured to lock into the pair of grooves 120 of the flat grooved surface 18 with a locking fin portion to prevent spinning of the kettlebell handle attachment 82, or alternatively spin freely within the pair of grooves 120 of the flat grooved surface 18. The small bar portion 50 may comprise of a single molded piece with the large bar portion 84, blocking brace portion 78, and holder portion 86, or comprise a separate piece attached to the large bar portion 84, and blocking brace portion 78 by means of bolt, screw, weld, carbon fiber wrap, adhesive, or other means of adhesion while still meeting the requirements of the intended embodiment.

The holder portion 86 may alternatively comprise of various shapes and sizes of tubing including, but not limited to, round, square, oval, triangular, hexagonal, etc. Including but not limited to, round, oval, triangular, square, trapezoidal, quadrilateral, linear etc. The holder portion 86 may alternatively comprise of a textured or smooth, or anatomical surface, and may be further configured to be rigid, semi-rigid, or pliable. The holder portion 86 may comprise of various materials including plastic, metal, fiberglass, carbon fiber, etc., and may be made of a solid material, hollow shell, compartmentalized shell, or filled completely or partially with various material to add weight or strength. The holder portion 86 may be configured to spin through use of a thrust washer, bushing, or other means, in conjunction with large bar portion 84. The holder portion 86 may comprise of a single molded piece with the large bar portion 84, small bar portion 50, and blocking brace portion 78, or comprise a separate piece attached to the large bar portion 84 by means of bolt, screw, weld, carbon fiber wrap, adhesive, or other means of adhesion while still meeting the requirements of the intended embodiment.

The padded handle grip 70 may comprise of various materials including, but not limited to, rubber, neoprene, foam, plastic, etc., and may be of anatomical shape for the hand.

FIG. 8 illustrates a possible variation of the present disclosure referred to as the weight variation system, allowing for the addition and subtraction of additional optional weighted members 156 to each hemisphere element 12, modifying the stability and difficulty of the apparatus. The weighted variation system may comprise of multiple small recessed lateral cavities 23 within the large recessed centralized cavity 22 of each hemisphere element 12, lateral spring plates 152 extending from rib cover plate 134, a pair of retaining edges 160, and optional weighted members 156. The small recessed lateral cavities 23 may be configured such that the additional weighted members 156 are inserted into the small recessed lateral cavities 23 and secured in place by the combination of the pair of retaining edges 160 and pressure applied by the lateral spring plates 152. Additionally, the flat grooved surface 18 of the hemisphere element 12 may be configured with recessed grooves 154 to allow the user better user access for the insertion and removal of the optional weighted members 156.

Alternate embodiments of the weight variation system may include, but are not limited to, variations in the small recessed lateral cavities 23, lateral spring plates 152, pair of retaining edges 160, and optional weighted members 156.

The small recessed lateral cavities 23 may comprise of one or multiple cavities or various shapes and sizes, including but not limited to, cylindrical, rectangular, square, semi-circular, hexagonal, etc., and may be of various depths and lengths. The small recessed lateral cavities 23 may be of textured or smooth surface. The small recessed cavity may comprise of a continuous molded piece within the large recessed centralized cavity 22, or of a secondary piece adhered within the large recessed centralized cavity 22 by means of adhesive, weld, screws, carbon fiber wrap, or alternate form of adhesion while still meeting the requirements of the intended embodiment.

The lateral spring plates 152 may comprise of one or multiple lateral spring plates 152 in relation to the number of small recessed lateral cavities 23. Each lateral spring plate 152 may be an extension of the rib cover plate 134 as illustrated in FIG. 8, a separate piece for each small recessed lateral cavity 23, or a separate piece comprised of multiple lateral spring plates 152 detached from the rib cover plate 134. The lateral spring plate 152 may comprise of a solid, semi-rigid, or pliable material, and may comprise of various materials including plastic, metal, fiberglass, carbon fiber, etc. The lateral spring plate 152 may alternately consist of a metal or plastic coil spring, or plunger button, while still meeting the requirements of the intended embodiment. The lateral spring plate 152 may be of various tensions.

The pair of retaining edges 160 may comprise of one or a multiple pair of retaining edges 160 in relation to the number of small recessed lateral cavities 23. The pair of retaining edges 160 may be of various shapes including, but not limited to, rectangular, square, oval, round, triangular, etc. The pair of retaining edges 160 may comprise of a continuous molded piece within the large recessed centralized cavity 22, or alternately be comprised of a separate piece adhered within the large recessed centralized cavity 22, or small recessed lateral cavity 23 by means of adhesive, weld, screws, carbon fiber wrap, or alternate form of adhesion while still meeting the requirements of the intended embodiment. The pair of retaining edges 160 may comprise of a separate piece, such as a rubber or plastic ring that rests inside the large recessed centralized cavity 22 and is not adhered directly to the other parts of the weight variation system. The pair of retaining edges 160 may comprise of a solid, semi-rigid, or pliable material, and may comprise of various materials including plastic, metal, fiberglass, carbon fiber, etc. The pair of retaining edges 160 may be of various length or thickness.

The optional weighted members 156 may comprise of one or multiple optional weighted member in relation to the number of small recessed lateral cavities 23. The optional weighted members 156 may comprise of various sizes and shapes including, but not limited to, square, round, triangular, cylindrical, hexagonal, etc. The optional weighted members 156 may comprise of various materials including plastic, metal, fiberglass, carbon fiber, etc., and be of varying weight levels. The optional weighted members 156 may be solid, semi-rigid, or pliable material while still meeting the intended requirements of the embodiment.

Figure 9:
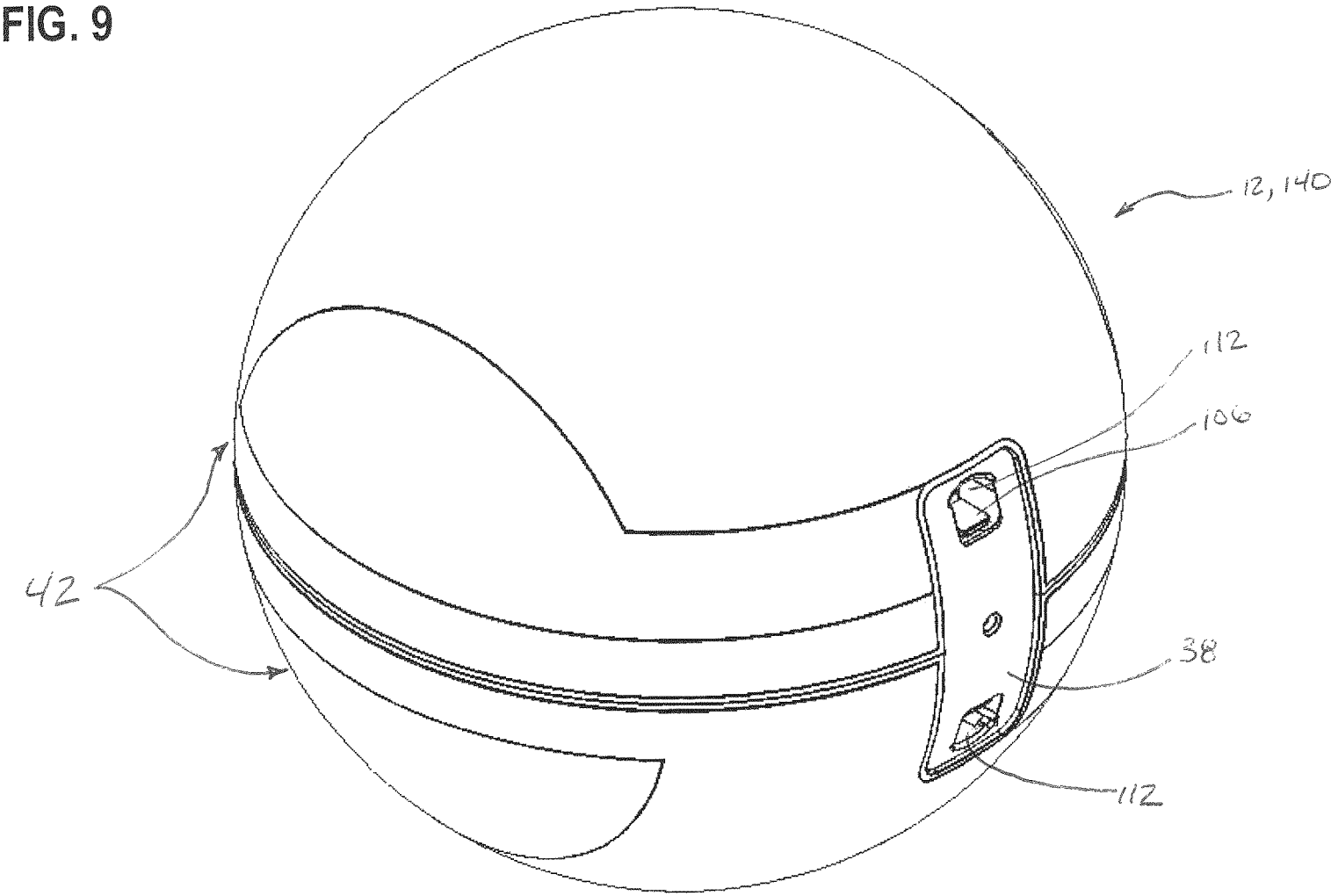
FIG. 9 shows another perspective view of the pair of hemispherical push-up exercise devices held together by the U-shaped locking mechanism, forming a medicine ball, according to one embodiment of the present disclosure.

FIG. 9 illustrates an alternate configuration of the pair of hemisphere elements 12 held together by a pair U-shaped locking mechanisms 38. The rounded outer surfaces 20 of the hemisphere elements 12 may be coated with a rubberized outer molding 140. The U-shaped locking mechanism 38 may comprise of a pair of medium apertures 112 for accessing the finger tab recessed lever 106.

Figure 10:
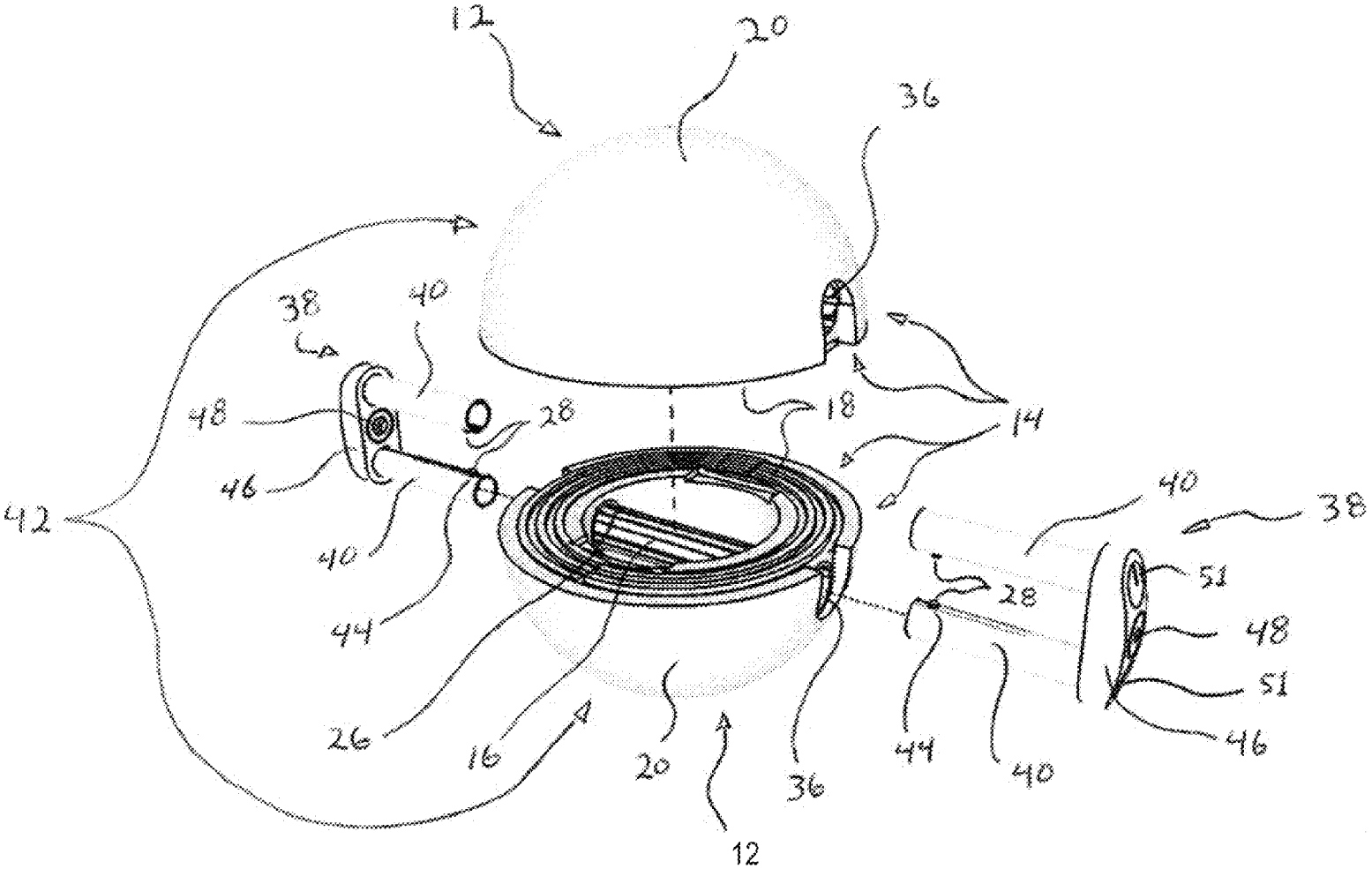
FIG. 10 shows another partially exploded, perspective view of the pair of hemispherical push-up exercise devices held together by the U-shaped locking mechanism, forming a medicine ball, according to one embodiment of the present disclosure.

FIG. 10 illustrates an example embodiment showing the conjoining of the two identical hemisphere elements 12, using a pair of U-shaped locking mechanism 38, into a single medicine ball configuration 42. Each locking mechanism may include the pair of arm portions 40, a small aperture 44 on each arm portion 40, the spring-loaded ball plunger 28 recessed inside each said small apertures 44, and a base element 46 with a centralized component connection aperture 48 for accommodating an attachment bolt, and two grooves 51 that may allow access to inside of each of the arm portions 40. Each spring-loaded ball plunger 28 may be replaced with the spring-loaded button 32 with the actuator lever 34 that may traverse the grooves 51 on the base element 46 as illustrated in FIGS. 12, 13 and 14. This configuration may allow the user to unlock the U-shaped locking mechanism 38 remotely from the outside.

Figure 11:
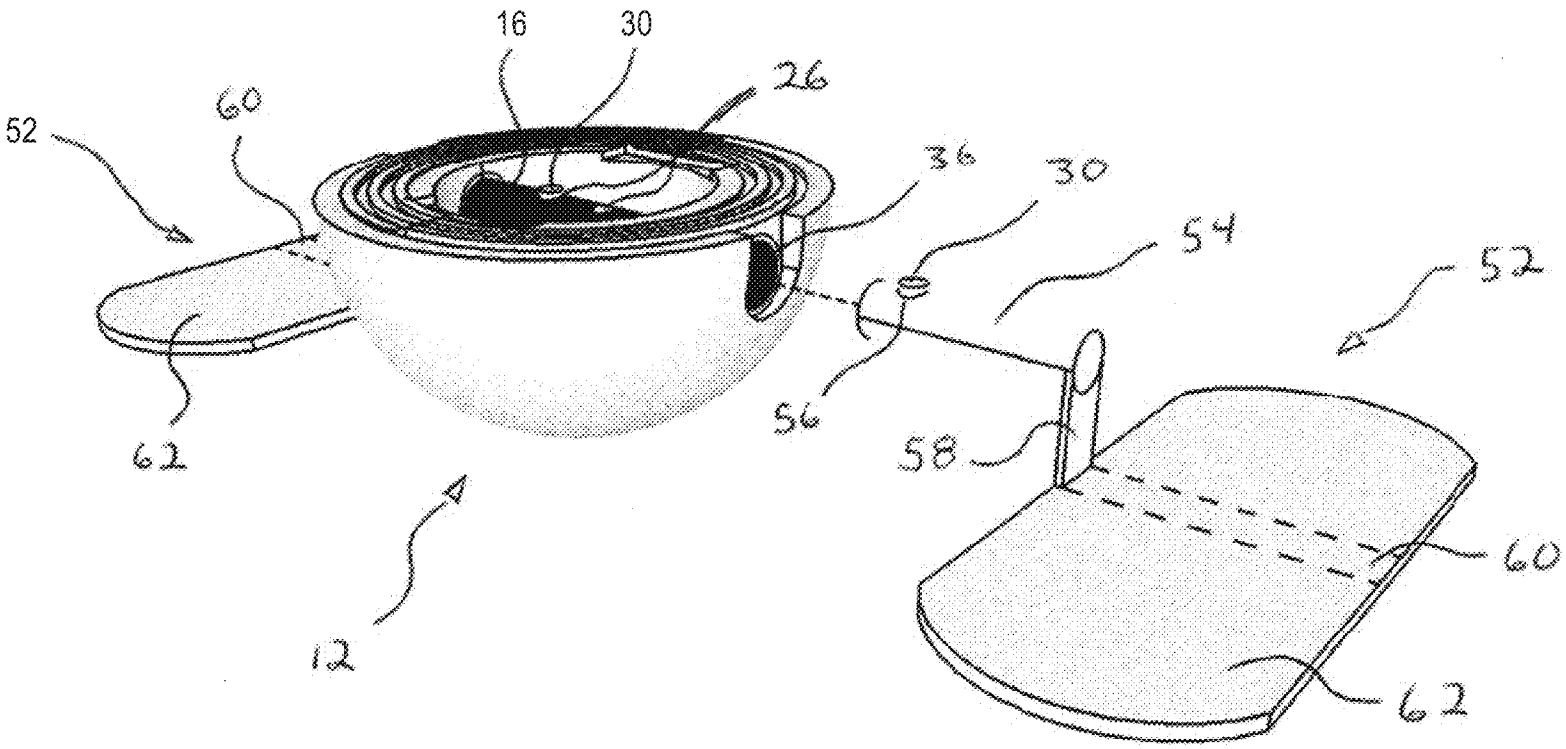
FIG. 11 shows a perspective view of an alternate configuration of a single hemispherical push-up exercise device with a pair of foot plate attachments, according to one embodiment of the present disclosure.

FIG. 11 illustrates an alternative embodiment for a pair of foot plate attachments 52 that may be attached to the hemisphere elements 12 to provide a lower extremity balancing apparatus. Each of the foot plate attachments 52 includes an arm segment 54, the spring-loaded push button 30 traversing a small aperture 56 on the arm segment 54, a vertical stay portion 58, a horizontal stay portion 60, and a foot plate 62. The spring-loaded push button 30 may be aligned with the locking apertures 26 of the horizontal cross member 16 of the hemisphere elements 12 when the arm segment 54 of the foot plate attachment 52 is fully inserted into the attachment aperture 36 of the horizontal cross member 16 of the hemisphere elements 12, thus locking it in position. In one embodiment, the small aperture 56 of the arm segment 54 and the locking apertures 26 on the horizontal cross member 16 may be positioned to align at any location on the arm segment 54 and horizontal cross member 16, while achieving the intended function of locking the foot plate attachments 52 to the hemisphere elements 12. In one embodiment, the arm segments 54 of the foot plate attachments 52 may be tubular in shape. In further embodiments, the arm segments 54 may be of any shape including triangular, square, hexagonal, etc. that may coincide with the shape of the attachment aperture 36 and horizontal cross member 16 of the hemisphere elements 12.

FIG. 12 illustrates an alternative embodiment for spinning handle bar attachment 72. Each spinning handle bar attachment 72 may include the U-shaped locking mechanism 38 as described above in FIGS. 2 and 3, an small bar portion 50, a thrust bearing 74, and a bar portion 76 with the padded handle grip 70. As illustrated in FIG. 6, the bar portion 76 may include a blocking brace portion 78 or similar insert adhered into the proximal end to include the small bar portion 50. The bar portion 76, may alternatively comprise of plastic, carbon fiber, fiberglass, or other material, and may be molded with the equivalent of a washer, or insert, for the acceptance of the small bar portion 50. The bar portion 76 may be attached to the U-shaped locking mechanism 38 by inserting the small bar portion 50 through the centralized component connection aperture 48 of the base element 46, through the thrust bearing 74, then through the blocking brace portion 78 of the bar portion 76 and secured by placing the locking nut 80 at the end of the small bar portion 50.

The spinning handle bar attachment 72 may be configured to spin on the small bar portion 50 by placing the thrust bearing 74, and not securing the locking nut 80 so tight as to prevent spinning of the bar portion 76 on the small bar portion 50. Alternatively, the small bar portion 50 may be threaded along the entirety of the bolt, or only at the end for the attachment of the locking nut 80.

Alternate embodiments for the spinning handle bar attachment 72 may include, but are not limited to, variations to the U-shaped locking mechanism 38, the small bar portions 50, the bar portion 76, and padded handle grip 70.

The U-shaped locking mechanism 38 may alternatively be configured to attach directly to the spinning handle bar attachment 72 or remain unattached from the spinning handle bar attachment 72. The U-shaped locking mechanism 38 may alternatively comprise variations in size and shape of apertures to accommodate variations in locking components or attachment methods for the spinning handle bar attachment 72.

The small bar portions 50 may comprise of different sizes, shapes, or lengths of bolt while still completing the intended function of the embodiment. Additionally, the small bar portions 50 may be configured to lock in place, or spin freely within the base element 46 of the U-shaped locking mechanism 38.

The bar portion 84 may comprise of various shapes and sizes including, but not limited to, round, square, triangular, hexagonal, anatomical, etc. The bar portion 84 may comprise of a texture or smooth surface, and may be rigid, semi-rigid, or pliable. The bar portion 84 may comprise of various materials including plastic, metal, fiberglass, carbon fiber, etc., and may be made of a solid material, hollow shell, compartmentalized shell, or filled completely or partially with various materials to add weight or strength.

The padded handle grip 70 may comprise of various materials including, but not limited to, rubber, neoprene, foam, plastic, etc., and may be of anatomical shape for the hand. Possible manufacturing techniques for the bar portion 76 of the spinning handle bar attachment 72 are the same as those described above for the shaft portion 66 of the handle bar attachment 64 described above in detail for FIG. 5. The bar portion 76 is depicted as having a blocking brace portion 78, or similar insert, adhered by welding into the proximal end to accept the small bar portions 50. The bar portion 76, may comprise of plastic, carbon fiber, fiberglass, or other material, and may be molded with the equivalent of a washer, or insert for the acceptance of the small bar portions 50. The small bar portions 50, the thrust bearing 74, the blocking brace portion 78 and the locking nut 80 are all common items available in the marketplace. The padded handle grip 70 may comprise of rubber, neoprene, foam, plastic, or other material.

FIG. 13 illustrates a partially exploded view of an alternate embodiment for kettle bell handle attachment 82 where small bar portion 50 may comprise an small bar portion. The bar portion 84 is depicted as having the blocking brace portion 78, washer, or similar insert adhered into the proximal end to accept the small bar portion 50. The large bar portion 84 may be attached to the U-shaped locking mechanism by inserting the small bar portion 50 through the centralized component connection aperture 48 of the base element 46, then through the blocking brace portion 78 of the bar portion 84 and secured by placing the locking nut 80 at the end of the small bar portion 50. In alternative configurations, large bar portion 50 may be configured such that small bar portion 50 may thread directly into large bar portion 50. In other embodiments, kettle bell handle attachment 82 may be configured such that small bar portion 50 may thread through a retaining or locking plate/washer and spacer or sleeve portion before threading into large bar portion 84. In this embodiment, the U-shaped locking mechanism may be located between the locking plate/washer and large bar portion 84.

FIG. 14 illustrates an enlarged, cross-sectioned view of the U-shaped locking mechanism 38 as described in FIG. 2, including the spring-loaded button 32, the actuator lever 34, and the finger tab 35 inside of the arm portions 40. The actuator lever or arms 34 exit the base element 46 through the two grooves 51 allowing the user to disengage the spring-loaded button 32 remotely from the outside of the U-shaped locking mechanism 38. Possible manufacturing techniques for the locking mechanism 38 discussed above in detail for FIG. 2, apply here as well. The spring-loaded button 32 and the actuator lever 34 may comprise of metal, spring metal, plastic, or other material that retains its shape. The finger tab 35 may alternatively comprise of plastic, metal, or other material, and may be configured in various shapes.

Figure 15:
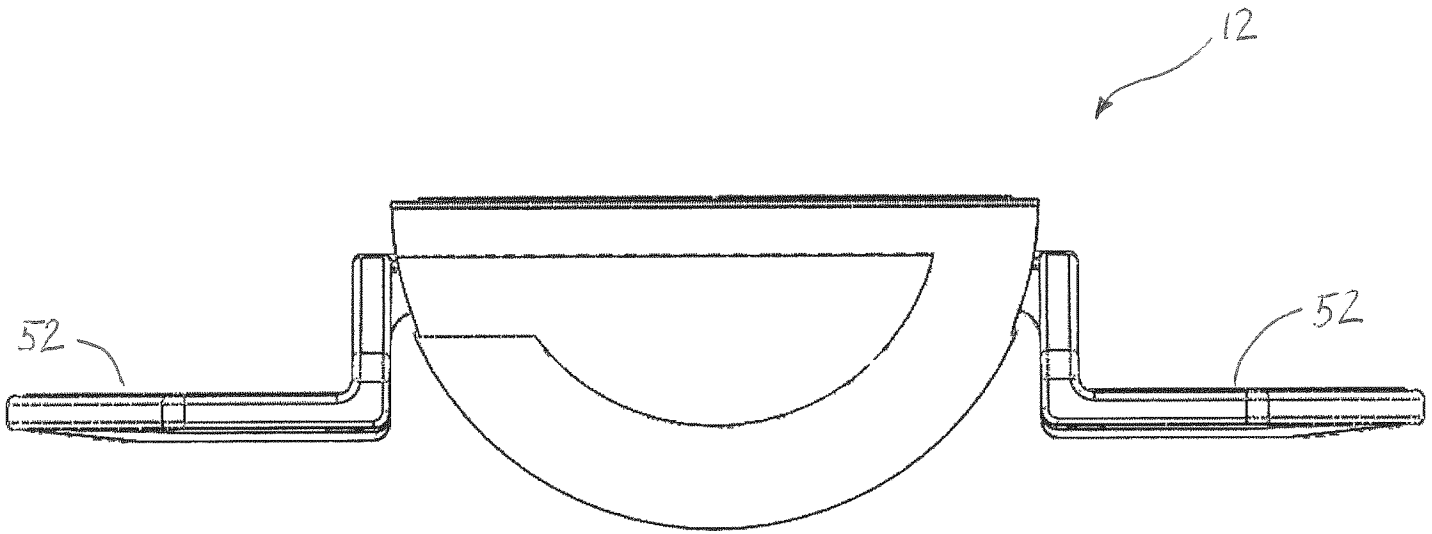
FIG. 15 shows a front view of a single hemispherical push-up exercise device with an alternate configuration of the foot plate attachments, according to one embodiment of the present disclosure.

FIG. 15 shows a front view of a single hemispherical push-up exercise device with an alternate configuration of the foot plate attachments. In this configuration, hemisphere element 12 includes foot plate attachments 52 with a possible height dimension from the bottom of the foot plate attachments 52 to a floor. The foot plate attachment 52 may be configured to be of varying height from the floor, or alternatively, may be configured to be of adjustable height.

Figure 16:
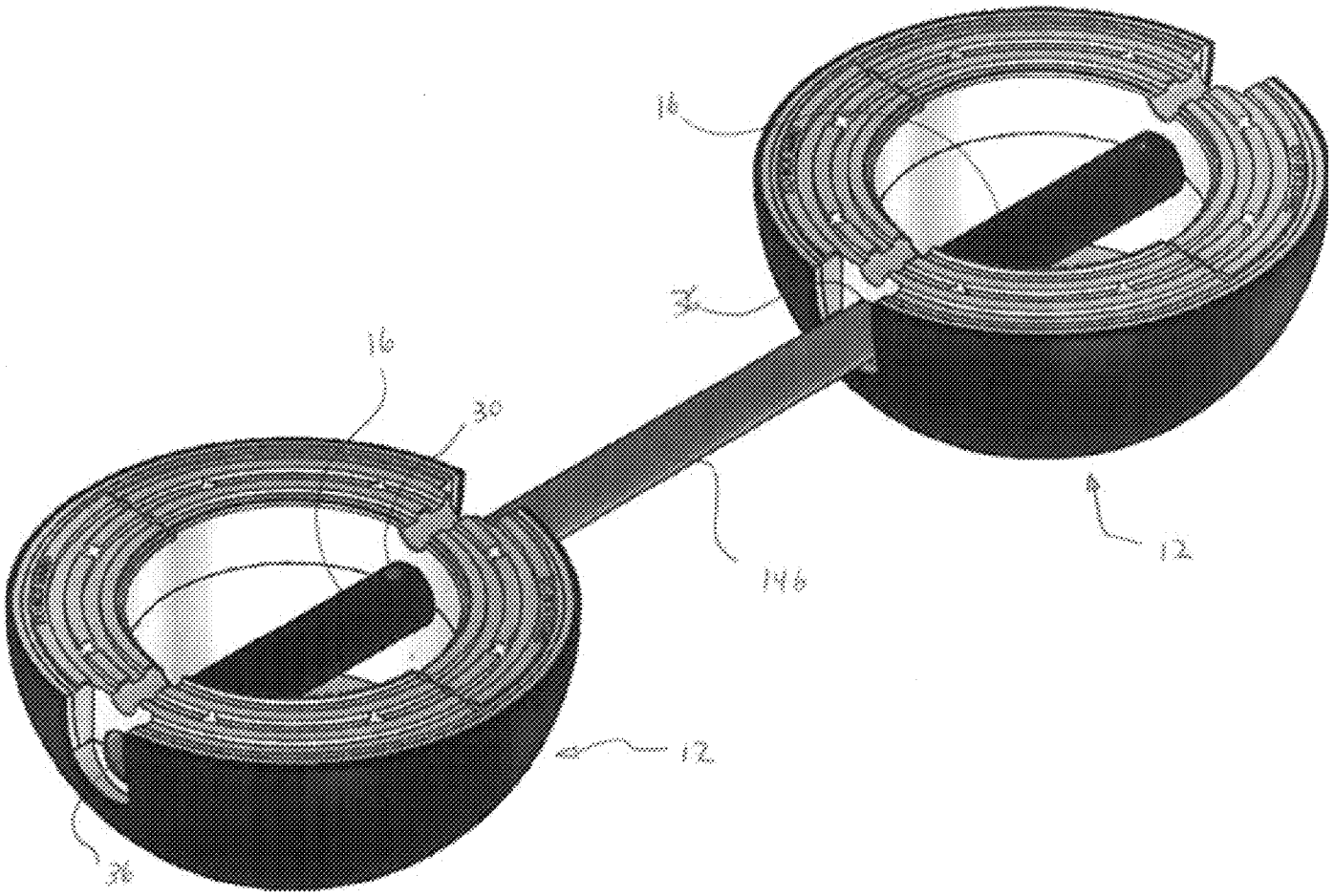
FIG. 16 shows a perspective view of a pair of hemispherical push-up exercise devices with a cross bar attachment, according to one embodiment of the present disclosure.

FIG. 16 illustrates of a pair of hemisphere elements 12 held together by a cross bar attachment 146, forming an alternate embodiment of push-up or balance exercise device. The cross bar attachment 146 may be inserted into each horizontal cross member 16 of the hemisphere elements 12 through the attachment aperture 36, and locked into position by the spring-loaded push button 30. The cross bar attachment 146 may be configured to be of various lengths. The cross bar attachment 146 may comprise of various shapes including, but not limited to, round, square, triangular, hexagonal, etc. Additionally, the cross bar attachment 146 may comprise of a solid material, or alternatively of a hollow shell, a compartmentalized shell, or be filled completely or partially with various materials to add weight or strength. The cross bar attachment 146 may alternatively comprise of a rigid, semi-rigid, or flexible material. Additionally, the cross bar attachment 146 may be configured to be of various textures or padded hand grips, or be configured with anatomically correct hand grips.

Thus a transformable exercise apparatus is described that allows the user to perform various upper and lower body strength and stability exercises using one primary piece of equipment. The disclosure provides an exercise device where the exercises are performed on curved surface, which is inherently less stable, and requires the user to use more neuro-muscular control while the exercises are performed. The device allows for multiple attachments to be added, providing various challenges to the user for both upper and lower body segments. Each hemisphere may be used independently as push-up devices or dumbbells, and may be manufactured of different weights for different levels of user strength. The hemispheres also have the advantage of being locked together to form a weighted medicine ball, which may also aid for easier storage. It is to be understood that the present disclosure is not limited to the embodiments described above, but encompasses any and all the embodiments within the scope of the claims.

As described above, for illustration purposes and not as a limitation, an exercise device is disclosed with a first hemisphere element having a first recessed cavity with a first horizontal cross member traversing the first cavity, a second hemisphere element having a second recessed cavity with a second horizontal cross member traversing the second cavity, and a locking mechanism to lock the first hemisphere to the second hemisphere in a locked ball configuration. The locking mechanism may be positioned such that it is flush with an outer surface of the device when in a locked ball configuration. The first hemisphere may further have a first opening and the second hemisphere may have a second opening, where the first opening and second opening are positioned to receive the locking mechanism in the locked ball configuration. The first hemisphere may have a first interlocking surface and the second hemisphere may have a second interlocking surface where the first interlocking surface and second interlocking surface engage in the locked ball configuration. In some examples, the first interlocking surface and the second interlocking surface may be grooved surfaces.

In some examples, the locking mechanism may be a U-shaped locking mechanism. The U-shaped locking mechanism may include a first arm portion to extend into a first opening of the first hemisphere and a second arm portion to extend into a second opening of the second hemisphere. Further, the locking mechanism may include at least one actuator lever and/or at least one component connection aperture. Additional features and components are described above.

It is to be understood that the configurations and/or approaches described herein are exemplary in nature, and that these specific embodiments or examples are not to be considered in a limiting sense, because numerous variations are possible. The subject matter of the present disclosure includes all novel and nonobvious combinations and sub combinations of the various configurations, and other features, functions, and/or properties disclosed herein.

The invention claimed is:

1. A transformable exercise device comprising:

a pair of hemisphere elements wherein each element comprises a rounded outer surface, a flat grooved surface, and a large recessed centralized cavity; and a horizontal cross member traversing the large recessed centralized cavity, below the flat grooved surface, comprising:

a hand grip;

a locking aperture for accepting at least one of a locking tab, a spring-loaded push button, a spring-loaded ball plunger, and a spring-loaded button of an exercise attachment;

an attachment aperture at each terminus of the horizontal cross member extending from the horizontal cross member to the rounded outer surface;

wherein each of the pair of attachment apertures is configured to receive an exercise attachment; and a pair of U-shaped locking mechanisms, each of the pair of U-shaped locking mechanisms including two arm portions, each of the two arm portions configured to fit into the attachment aperture of the horizontal cross member of each of the pair of hemisphere elements when conjoined into a medicine ball configuration, locking the pair of hemisphere elements into a spherical shape.

2. The transformable exercise device of claim 1, further comprising a kettlebell handle attachment inserted between a pair of grooves on the flat grooved surface of each of the pair of hemisphere elements conjoined in the medicine ball configuration and locked in place with the U-shaped locking mechanisms providing a kettlebell device.

3. The transformable exercise device of claim 1, further comprising a pair of foot plate attachments, each of the pair of foot plate attachments inserted into the attachment aperture at each terminus of the horizontal cross member of the hemisphere elements, and locked into place with the spring-loaded push button traversing the locking aperture of the horizontal cross member, providing a lower extremity balance device.

4. The transformable exercise device of claim 1, further comprising a pair of handle bar attachments, each of the pair of handle bar attachments inserted into the attachment aperture at each terminus of the horizontal cross member of the hemisphere elements and locked in place with the spring-loaded push button traversing the locking aperture of the horizontal cross member, providing a wide grip, single fulcrum push-up device.

5. The transformable exercise device of claim 1, further comprising of a spinning handle bar attachment inserted into a pair of grooves on the flat grooved surfaces of each of the pair of hemisphere elements conjoined in the medicine ball configuration and locked in place with the U-shaped locking mechanisms providing a rolling device.

6. An exercise device comprising:

a first hemisphere element having a first recessed cavity with a first horizontal cross member traversing the first recessed cavity;

a second hemisphere element having a second recessed cavity with a second horizontal cross member traversing the second recessed cavity;

a locking mechanism to lock the first hemisphere element to the second hemisphere element in a locked ball configuration, wherein the locking mechanism is a U-shaped locking mechanism, and wherein the locking mechanism includes at least one component connection aperture centrally located within a base element of the locking mechanism; and the first hemisphere element and the second hemisphere element locked in the locked ball configuration, a kettlebell handle attachment inserted into the at least one component connection aperture of the locking mechanism providing a kettlebell device.

7. The exercise device of claim 6, wherein the first hemisphere element includes a first interlocking surface and the second hemisphere element includes a second interlocking surface, where the first interlocking surface engages the second interlocking surface in the locked ball configuration.

8. The exercise device of claim 7, wherein the first interlocking surface and the second interlocking surface are grooved surfaces.

9. The exercise device of claim 6, wherein the first hemisphere element includes a first opening and the second hemisphere element includes a second opening and where the first opening and the second opening are positioned to receive the locking mechanism in the locked ball configuration.

10. The exercise device of claim 6, wherein the locking mechanism includes at least one actuator lever.

11. The exercise device of claim 6, wherein the locking mechanism includes a first arm portion to extend into a first opening of the first hemisphere element and a second arm portion to extend into a second opening of the second hemisphere element.

12. The exercise device of claim 6, wherein the locking mechanism is flush with an outer surface of the exercise device when in the locked ball configuration.

13. The exercise device of claim 6, wherein each of the first recessed cavity and the second recessed cavity includes a plurality of smaller recessed lateral cavities, each smaller recessed lateral cavity configured to house an additional weighted member.

14. An exercise device comprising:

a first hemisphere element having a first recessed cavity with a first horizontal cross member traversing the first recessed cavity;

a second hemisphere element having a second recessed cavity with a second horizontal cross member traversing the second recessed cavity;

a locking mechanism to lock the first hemisphere element to the second hemisphere element in a locked ball configuration, wherein the locking mechanism is a U-shaped locking mechanism, and wherein the locking mechanism includes at least one component connection aperture centrally located within a base element of the locking mechanism; and a spinning handle bar attachment inserted into the at least one component connection aperture of the locking mechanism while in the locked ball configuration.

* * * * *